US006575128B2

(12) United States Patent
Nakamura et al.

(10) Patent No.: US 6,575,128 B2
(45) Date of Patent: Jun. 10, 2003

(54) VARIABLE-VALVE-ACTUATION APPARATUS FOR INTERNAL COMBUSTION ENGINE

(75) Inventors: Makoto Nakamura, Kanagawa (JP); Naoki Okamoto, Kanagawa (JP); Seinosuke Hara, Kanagawa (JP); Akinori Suzuki, Kawasaki (JP); Tsuneyasu Nohara, Kanagawa (JP); Shinichi Takemura, Yokohama (JP); Takanobu Sugiyama, Yokohama (JP); Shunichi Aoyama, Kanagawa (JP)

(73) Assignees: Unisia Jecs Corporation, Atsugi (JP); Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/086,674

(22) Filed: Mar. 4, 2002

(65) Prior Publication Data

US 2002/0166524 A1 Nov. 14, 2002

(30) Foreign Application Priority Data

May 9, 2001 (JP) ..... 2001-138206

(51) Int. Cl.[7] ..... F01L 1/34

(52) U.S. Cl. ..... 123/90.16; 123/90.15; 123/90.17; 123/90.18; 123/90.31

(58) Field of Search ..... 123/90.15–90.18, 123/90.31, 90.6

(56) References Cited

U.S. PATENT DOCUMENTS

| | | | | |
|---|---|---|---|---|
| 5,988,125 | A | 11/1999 | Hara et al. | 123/90.16 |
| 6,029,618 | A | 2/2000 | Hara et al. | 123/90.16 |
| 6,041,746 | A | 3/2000 | Takemura et al. | 123/90.16 |
| 6,055,949 | A | 5/2000 | Nakamura et al. | 123/90.16 |
| 6,123,053 | A | 9/2000 | Hara et al. | 123/90.16 |
| 6,397,800 | B2 * | 6/2002 | Nohara et al. | 123/90.15 |

FOREIGN PATENT DOCUMENTS

| | | |
|---|---|---|
| JP | 8-177434 | 7/1996 |

* cited by examiner

*Primary Examiner*—Thomas Denion
*Assistant Examiner*—Kyle Riddle
(74) *Attorney, Agent, or Firm*—Foley & Lardner

(57) ABSTRACT

In a VVA apparatus, when an actual lift amount detected by a lift-amount detecting sensor exceeds a basic lift-amount target value by a predetermined value or more, ECU corrects a lift phase through a lift-phase varying mechanism to separate from a piston TDC with respect to a basic lift-phase target value.

17 Claims, 33 Drawing Sheets

VARIABLE-VALVE-ACTUATION APPARATUS FOR INTERNAL COMBUSTION ENGINE

BACKGROUND OF THE INVENTION

The present invention relates to a variable-valve-actuation (VVA) apparatus for internal combustion engines, and more particularly, to a VVA apparatus comprising a lift-amount varying mechanism for varying the lift amount of engine valves such as intake valve and exhaust valve and a lift-phase varying mechanism for varying the lift phase in the advance-angle or lag-angle direction.

As is well known, various VVA apparatus have been provided to use in combination a valve-lift adjusting mechanism (lift-amount varying mechanism) for varying the valve lift amount of, e.g. an intake valve and a valve-timing adjusting mechanism (lift-phase varying mechanism) for varying the lift phase or peak lift timing of the intake valve to enhance the degree of freedom of the valve-lift characteristics and thus largely improve the engine operating performance.

Specifically, a typical VVA apparatus comprises a valve-lift adjusting mechanism for selectively switching a low-velocity cam and a high-velocity cam mounted to a camshaft in accordance with the engine operating conditions for variable control of the cam lift for an intake valve or an exhaust valve, and a valve-timing adjusting mechanism for changing the relative rotation phase between the camshaft and crankshaft in accordance with the engine operating conditions for variable control of the lift phase of the valve.

In the VVA apparatus, when the valve-timing adjusting mechanism fails, the valve-lift adjusting mechanism forcibly switches the cam to the low-velocity side, whereas when the valve-lift adjusting mechanism fails, the valve-timing adjusting mechanism controls the opening/closing timing of the engine valve to have the valve-lift operation center away from the top dead center (TDC) of a piston. Such control allows prevention of interference between the piston and the intake valve or exhaust valve or between the intake valve and the adjacent exhaust valve.

SUMMARY OF THE INVENTION

With the above VVA apparatus, as described above, in the event of failure of the valve-lift adjusting mechanism, the valve-timing adjusting mechanism carries out control to have the valve-lift operation center away from TDC for prevention of interference between the intake valve and the adjacent exhaust valve, which, however, is carried out uniformly even during lift control of the low-velocity cam. This involves impossible approach of the valve-lift operation center to TDC during control of the low-velocity cam, failing to obtain fully advanced closing timing of the intake valve when the VVA apparatus is applied to the intake side. As a result, an effect of reduction in pumping loss is attenuated to make achievement of enhanced fuel consumption difficult.

Moreover, full enlargement of overlap of the intake valve and exhaust valve cannot be expected to make difficult achievement of enhanced fuel consumption due to increased residual gas in cylinders, etc.

Interference between the piston and the engine valve in the event of failure of the valve-timing or valve-lift adjusting mechanism can be prevented by increasing a valve recess in a piston crown face. However, this solution may cause remaining of unburned gas in the valve recess to lower the emission performance for exhaust gas such as HC.

It is, therefore, an object of the present invention to provide a VVA apparatus for internal combustion engines, which allows achievement of enhanced fuel consumption with excellent exhaust emission performance.

The present invention provides generally a VVA apparatus for an internal combustion engine, which comprises a first varying mechanism which controls a lift amount of an engine valve in accordance with engine operating conditions; a second varying mechanism which controls a lift phase of the engine valve in accordance with the engine operating conditions; a first sensor which detects an actual position of the first varying mechanism, the actual position corresponding to an actual lift amount; a second sensor which detects an actual position of the lift-phase varying mechanism, the actual position corresponding to an actual lift phase; and an ECU which controls the lift amount and the lift phase to first and second basic target values through the first and second varying mechanisms, respectively. When the actual lift amount exceeds the first basic target value by a predetermined value or more, the ECU corrects the lift phase through the second varying mechanism to separate from a TDC of a piston with respect to the second basic target value.

BRIEF DESCRIPTION OF THE DRAWINGS

The other objects and features of the present invention will be apparent from the description with reference to the accompanying drawings wherein.

DETAILED DESCRIPTION OF THE INVENTION

Figure 1:
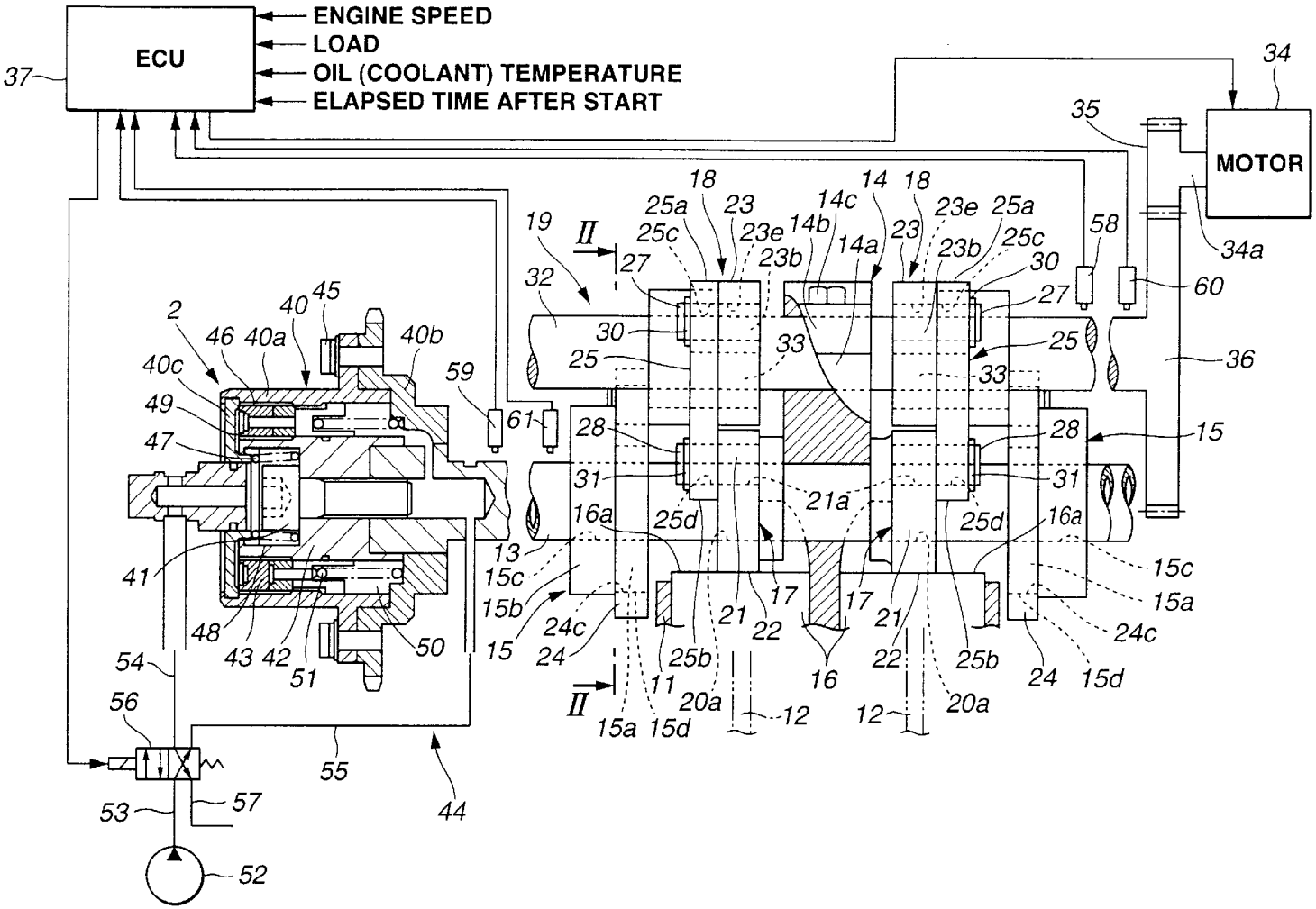
FIG. 1 is a longitudinal section showing a first embodiment of a VVA apparatus for an internal combustion engine according to the present invention.

Referring to FIG. 1, there is shown a first embodiment of a VVA apparatus for an internal combustion engine according to the present invention. In the illustrative embodiment, the VVA apparatus is applied to the intake side, and comprises two intake valves 12, 12 per cylinder slidably mounted to a cylinder head 11 through a valve guide, not shown, a lift-amount (first) varying mechanism 1 for varying the lift amount of intake valves 12, 12 in accordance with the engine operating conditions, and a lift-phase (second) varying mechanism 2 for varying the lift phase of intake valves 12, 12 in accordance with the engine operating conditions.

Figure 2:
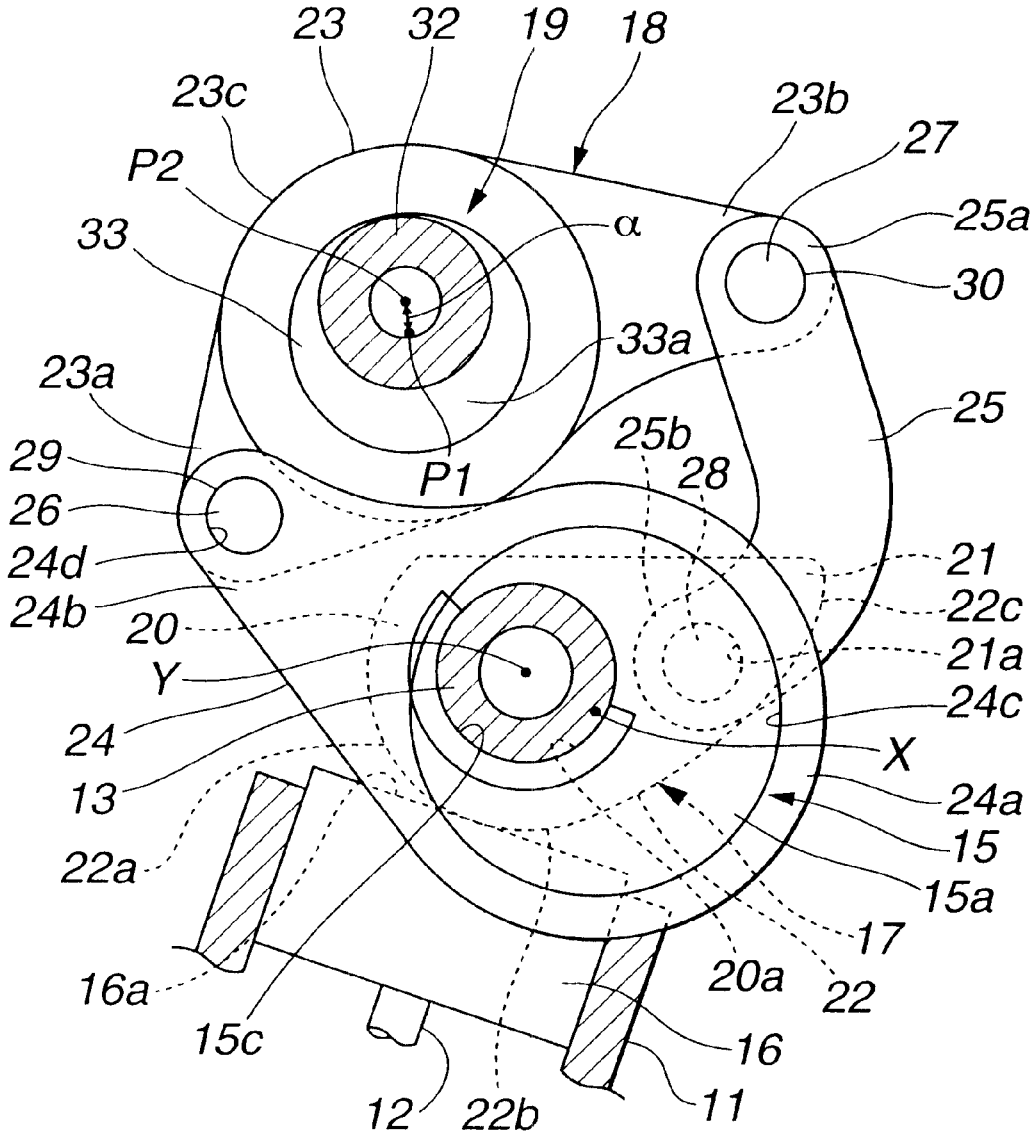
FIG. 2 is a cross section taken along the line II—II in FIG. 1.
Figure 3:
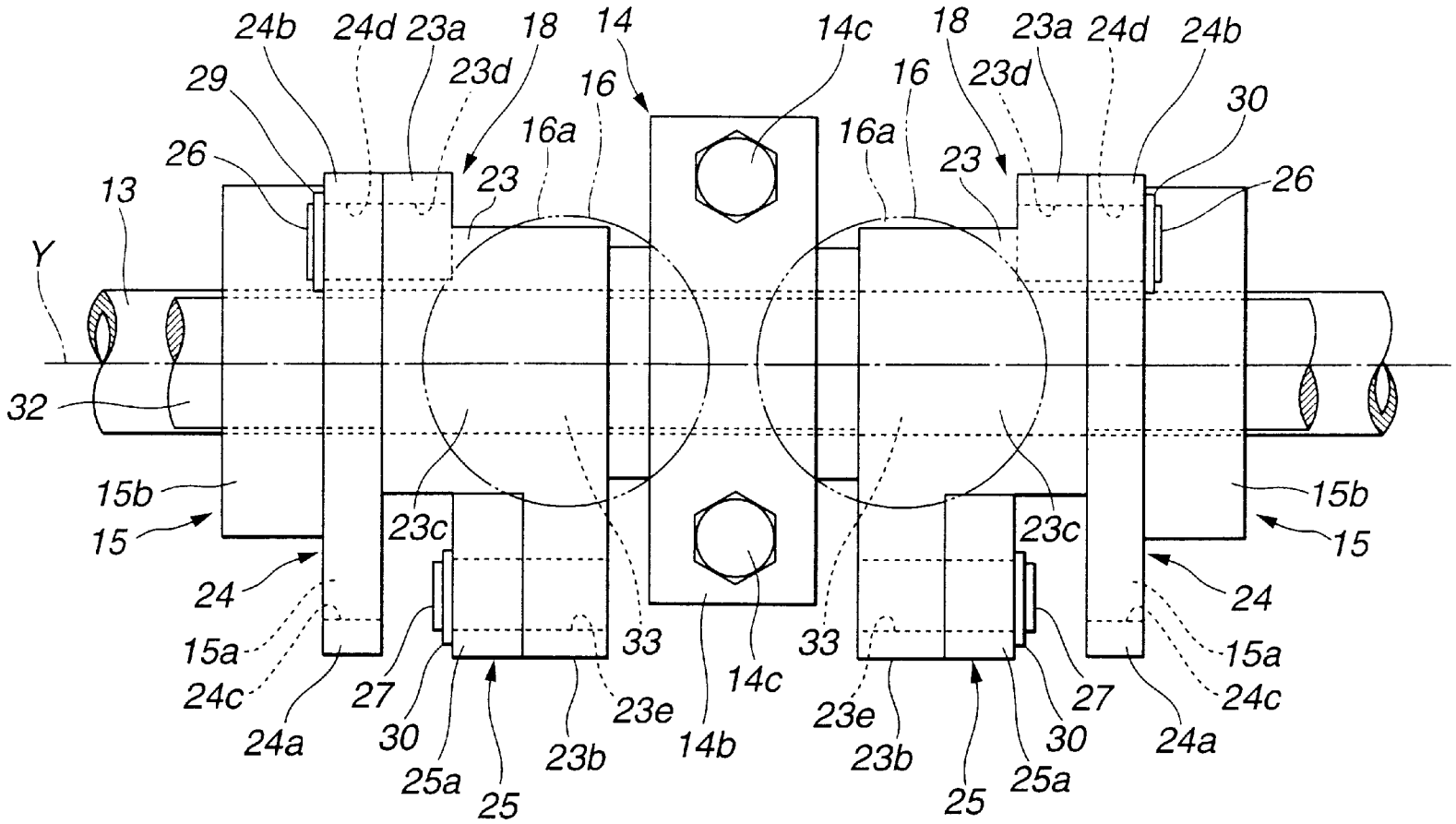
FIG. 3 is a plan view showing a lift-amount varying mechanism.

Referring to FIGS. 1–3, lift-amount varying mechanism 1 comprises a hollow driving shaft 13 rotatably supported by a bearing 14 in an upper portion of cylinder head 11, two crank cams or eccentric rotary cams 15, 15 fixed to driving shaft 13 through press fitting or the like, two valve operating (VO) cams 17, 17 swingably supported on driving shaft 13 and coming in slide contact with flat top faces 16*a*, 16*a* of valve lifters 16, 16 disposed at the upper ends of intake valves 12, 12, two transmission mechanisms 18, 18 each interposed between crank cam 15 and VO cam 17 for transmitting torque of crank cam 15 to VO cam 17 as a rocking force, and a control mechanism 19 for variably controlling the operating position of transmission mechanisms 18, 18.

Driving shaft 13 extends in the engine longitudinal direction, and has one end with a timing sprocket 40 of lift-phase varying mechanism 2 as will be described later, a timing chain wound thereon, etc., not shown, through which driving shaft 13 receives torque from an engine crankshaft.

As shown in FIG. 1, bearing 14 comprises a main bracket 14*a* arranged at the upper end of cylinder head 11 for supporting an upper portion of driving shaft 13, and an auxiliary bracket 14*b* arranged at the upper end of main bracket 14*a* for rotatably supporting a control shaft 32 as will be described later. Brackets 14*a*, 14*b* are fastened together from above by a pair of bolts 14*c*, 14*c*.

As best seen in FIG. 2, crank cam 15 is formed roughly like a ring, and comprises a main body 15*a* and a cylindrical portion 15*b* integrated with an outer end face of main body 15*a*. A through hole 15*c* is axially formed through crank cam 15 to receive driving shaft 13. An axis X of cam main body 15*a* is radially offset with respect to an axis Y of driving shaft 13 by a predetermined amount. Crank cams 15, 15 are press fitted via respective through holes 15*c* to driving shaft 13 at outer sides where no interference occurs with valve lifters 16, 16. As shown in FIG. 1, cam main bodies 15*a*, 15*a* have outer peripheral surfaces 15*d*, 15*d* of the same cam profile.

As best seen in FIG. 2, VO cam 17 has a roughly U-shaped profile, and includes one end or circular base end 20 engaged with driving shaft 13 and another end or cam nose 21 formed with a pin hole 21*a*. A lower side of VO cam 17 is formed with a cam face 22 including a base-circle face 22*a* located at base end 20, a ramp face 22*b* circularly extending from base-circle face 22*a* to cam nose 21, and a lift face 22*c* located at the tip of ramp face 22*b*. Base-circle face 22*a*, ramp face 22*b*, and lift face 22*c* come in contact with given points of top face 16*a* of valve lifter 16 in accordance with the rocking position of VO cam 17.

As best seen in FIG. 2, transmission mechanism 18 comprises a rocker arm 23 disposed above driving shaft 13, a crank arm 24 for linking one end or first arm 23*a* of rocker arm 23 with crank cam 15, and a link rod or member 25 for linking another end or second arm 23*b* of rocker arm 23 with VO cam 17.

As shown in FIG. 3, rocker arm 23 is formed roughly like a crank as viewed in plan, and includes a cylindrical base 23*c* located in the center and rotatably supported by a control cam 33 as will be described later. A pin hole 23*d* for a pin 26 allowing relatively rotatable coupling with crank arm 24 is formed through first arm 23*a* protruding from the outer end of base 23*c*, whereas a pin hole 23*e* for a pin 27 allowing relatively rotatable coupling with one end 25*a* of link rod 25 is formed through second arm 23*b* protruding from the inner end of base 23*c*.

As best seen in FIG. 2, crank arm 24 includes a relatively large-diameter annular base 24*a* and an extension 24*b* arranged in a predetermined position of the outer peripheral surface of base 24*a*. An engagement hole 24*c* is formed in the center of base 24*a* for rotatably receiving the outer peripheral surface of main body 15*a* of crank cam 15, whereas a pin hole 24*d* is formed through extension 24*b* for rotatably receiving pin 26.

Referring to FIGS. 1–2, link rod 25 is formed roughly like letter L having a predetermined length, and has first and second ends 25*a*, 25*b* formed with pin holes 25*c*, 25*d*. Rotatably arranged through pin holes 25*c*, 25*d* are ends of pins 27, 28 which are also arranged through pin hole 23*e* of second arm 23*b* of rocker arm 23 and pin hole 21*a* of cam nose 21 of VO cam 17, respectively.

Link rod 25 serves to restrict the maximum rocking range of VO cam 17 within the rocking range of rocker arm 23. Arranged at respective one ends of pins 26, 27, 28 are snap rings for restricting axial movement of crank arm 24 and link rod 25.

Control mechanism 19 comprises control shaft 32 arranged in the engine longitudinal direction, control cam 33 fixed at the outer periphery of control shaft 32 to form a rocking fulcrum of rocker arm 23, and an electric motor or actuator 34 for controlling the rotational position of control shaft 32.

As shown in FIG. 1, control shaft 32 is disposed parallel to driving shaft 13, and is rotatably supported between a bearing groove formed in the upper end of main bracket 14*a* and auxiliary bracket 14*b* as described above. Control cam 33 is of the cylindrical shape, an axis P1 of which is offset with respect to an axis P2 of control shaft 32 by a predetermined amount a as shown in FIG. 2.

Motor 34 transmits torque to control shaft 32 through mesh of a first spur gear 35 formed at an end of a driving shaft 34*a* of motor 34 with a second spur gear 36 formed at a rear end of control shaft 32. Motor 34 is driven in accordance with a control signal of an electronic control unit (ECU) 37 for determining the engine operating conditions.

As shown in FIG. 1, lift-phase varying mechanism 2 comprises a timing sprocket 40 arranged at the tip of driving shaft 13 for receiving torque of the engine crankshaft by means of a timing chain, not shown, a sleeve 42 fixed axially at the tip of driving shaft 13 by a bolt 41, a cylindrical gear 43 interposed between timing sprocket 40 and sleeve 42, and a hydraulic circuit or drive mechanism 44 for driving cylindrical gear 43 in the longitudinal axial direction of driving shaft 13.

Timing sprocket 40 comprises a cylindrical main body 40*a*, a sprocket 40*b* fixed at the rear end of main body 40*a* by bolts 45 and having a chain wound thereon, and a cover 40*c* for closing a front-end opening of main body 40*a*. The inner peripheral surface of main body 40*a* is formed with helical inner teeth 46.

Sleeve 42 has a rear end formed with an engaging groove with which the tip of driving shaft 13 is engaged, and a front end formed with a holding groove in which a coil spring 47 is provided to bias timing sprocket 40 forward. The outer peripheral surface of sleeve 42 is formed with helical outer teeth 48.

Cylindrical gear 43 includes two portions obtained by dividing from the axially right-angle direction, wherein the two gear components are biased by means of a pin and spring to approach each other. Cylindrical gear 43 has inner and outer peripheral surfaces formed with helical inner and outer teeth meshed with inner teeth 46 and outer teeth 48, respectively. Cylindrical gear 43 is moved in the longitudinal axial direction and in slide contact with the teeth by means of the hydraulic pressure provided relatively to first and second hydraulic chambers 49, 50 disposed before and after gear 43. In the maximally forward moving position of abutting on front cover 40*c*, cylindrical gear 43 controls intake valve 12 in the maximum lag-angle position, whereas in the maximally rearward moving position, it controls intake valve 12 in the maximum advance-angle position. When failing to receive the hydraulic pressure within first hydraulic chamber 49, cylindrical gear 43 is biased in the maximally forward moving position by a return spring 51 arranged in second hydraulic chamber 50.

As shown in FIG. 1, hydraulic circuit 44 comprises a main gallery 53 connected to the downstream side of an oil pump 52 communicating with an oil pan, not shown, first and second hydraulic passages 54, 55 branched from the downstream side of main gallery 53 to communicate with hydraulic chambers 49, 50, a solenoid-type passage selector valve 56 arranged in the branch position, and a drain passage 57 connected to passage selector valve 56.

Passage selector valve 56 is driven in accordance with a control signal derived from ECU 37 which also controls motor 34 of lift-amount varying mechanism 1.

Lift-amount varying mechanism 1 comprises a lift-amount detecting (first) sensor or means 58 for detecting an actual rotational position of control shaft 32, and an auxiliary lift-amount detecting (first auxiliary) sensor 60 for detecting the lift amount in an auxiliary way.

Likewise, lift-phase varying mechanism 2 comprises a lift-phase detecting (second) sensor or means 59 for detecting a relative rotational position between driving shaft 13 and timing sprocket 40, and an auxiliary lift-phase detecting (second auxiliary) sensor 61 for detecting the lift phase in an auxiliary way.

ECU 37 determines actual engine operating conditions through operation or the like in accordance with detection signals derived from various sensors, i.e. an engine-speed signal derived from a crank-angle sensor, an intake-air-flow or load signal derived from an airflow meter, an oil-temperature signal derived from an engine-oil temperature sensor, etc. ECU 37 provides control signals to motor 34 and passage selector valve 56 in accordance with detection signals derived from lift-amount detecting sensor 58 and lift-phase detecting sensor 59.

Specifically, ECU 37 determines a target lift characteristic of intake valve 12, i.e. a target rotational position of control shaft 32, in accordance with information signals indicative of engine speed, load, oil temperature, elapsed time after engine start, etc., based on which motor 34 is driven to rotate control cam 33 up to a predetermined rotation-angle position through control shaft 32. An actual rotational position of control shaft 32 is monitored through lift-amount detecting sensor 58 to rotate control shaft 32 to a target phase by means of feedback control.

Figure 4:
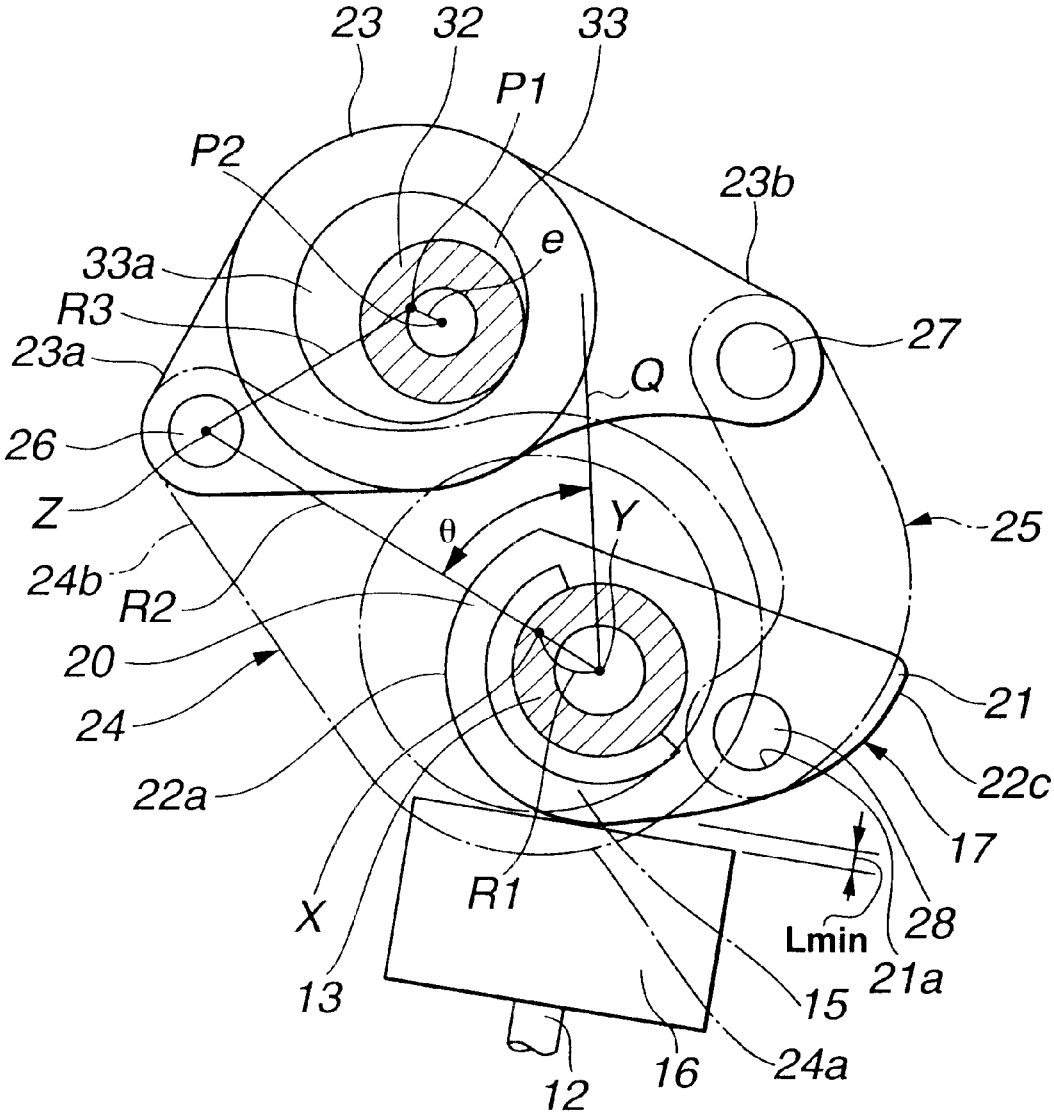
FIG. 4 is a view similar to FIG. 2, showing minimum lift control of the lift-amount varying mechanism.
Figure 5:
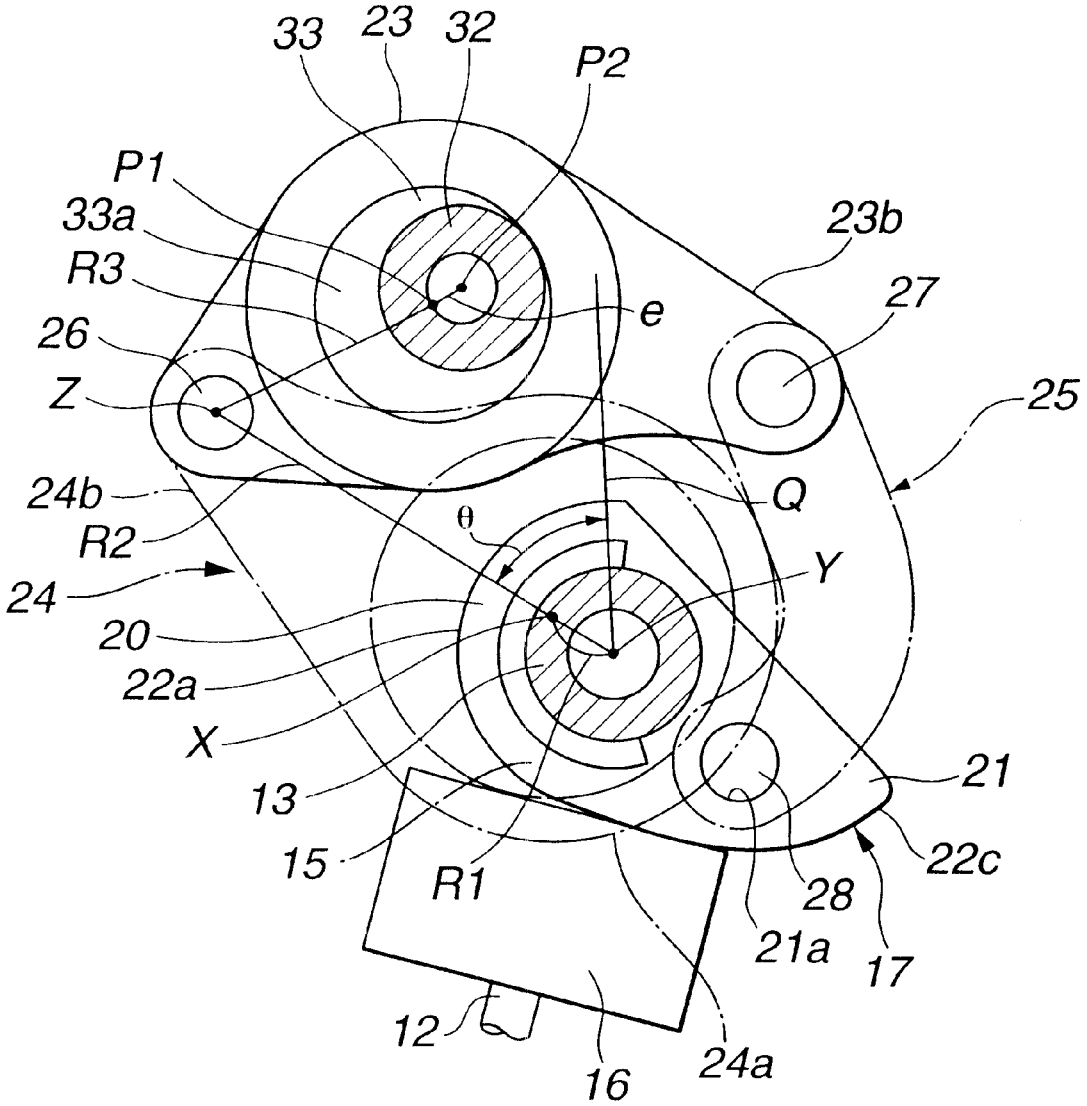
FIG. 5 is a view similar to FIG. 4, showing the process from maximum lift control to minimum lift control of the lift-amount varying mechanism.

Specifically, referring to FIG. 4, at the time of cranking in the initial stage of engine start or idling, control shaft 32 is rotated in one direction through motor 34 in accordance with a control signal derived from ECU 37, so that control cam 33 has axis P1 held in the rotational position left above axis P2 of control shaft 32, and a thick portion 33*a* rotated upward with respect to driving shaft 13. Thus, rocker arm 23 is moved in its entirety upward with respect to driving shaft 13, so that VO cam 17 is forcibly pulled upward through link rod 25 to rotate counterclockwise. Therefore, referring to FIGS. 4 and 7, when crank cam 15 is rotated to press first arm 23*a* of rocker arm 23 upward through crank arm 24, the corresponding lift amount is transmitted to VO cam 17 and valve lifter 16 through link rod 25, which has a small value L. This enhances gas flow and thus combustion, resulting in improved fuel consumption and stabilized engine rotation.

Figure 7:
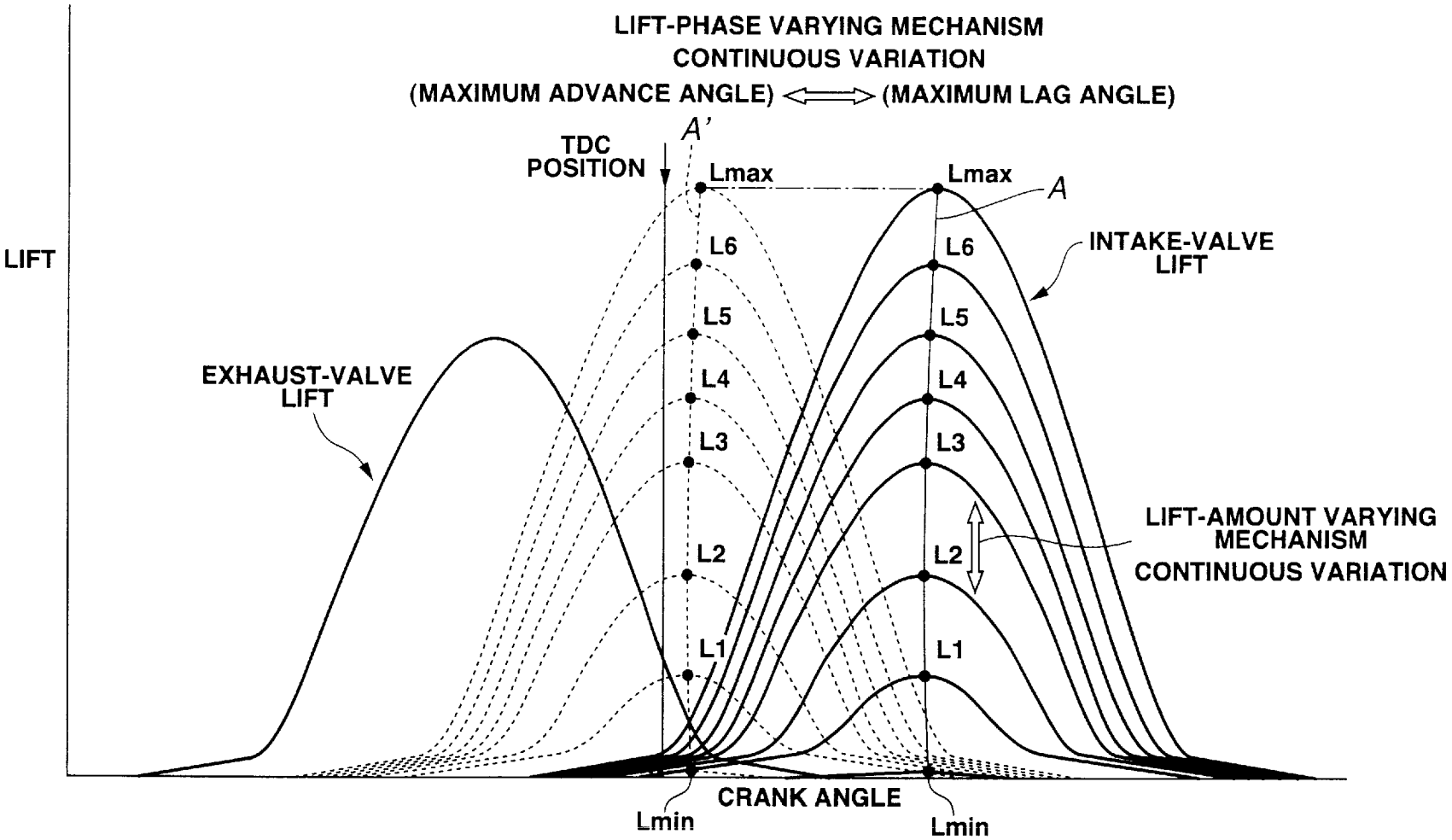
FIG. 7 is a graphical representation showing the characteristics of valve lift vs. crank angle.

At the time of cranking, particularly, the valve lift amount is set to zero or a minimum value Lmin close to zero as shown in FIG. 7, achieving excellent build-up of engine rotation as will be described later.

Figure 6:
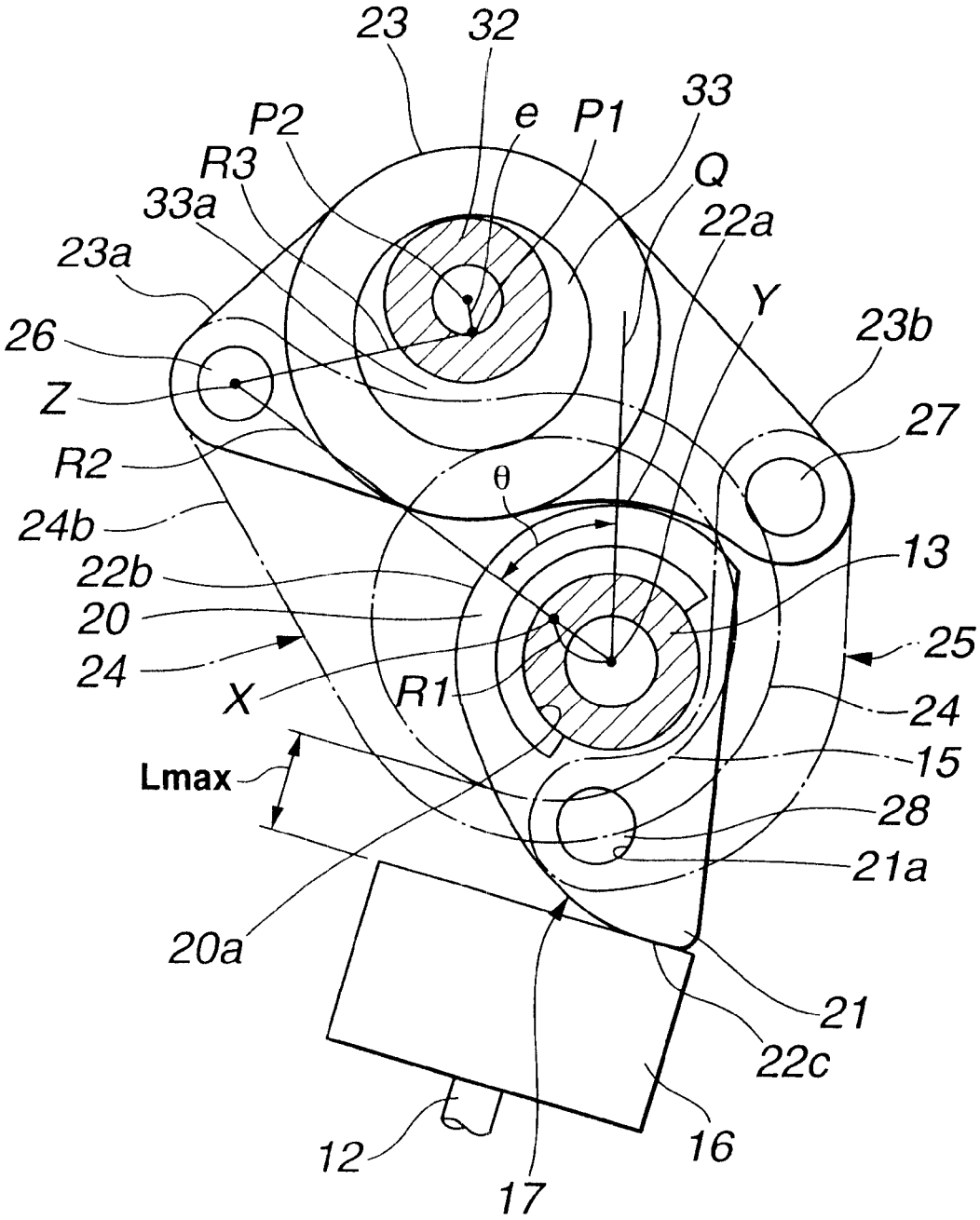
FIG. 6 is a view similar to FIG. 5, showing maximum lift control of the lift-amount varying mechanism.

On the other hand, in the high-rotation high-load range, control shaft 32 is rotated in another direction by motor 34 in accordance with a control signal derived from ECU 37 to rotate control cam 33 to the position shown in FIGS. 2 and 6 for downward rotation of thick portion 33*a*. Thus, rocker arm 23 is moved in its entirety to the driving shaft 13 or downward to have second arm 23*b* pressing VO cam 17 downward through rank arm 25, rotating VO cam 17 in its entirety to the position shown in FIGS. 2 and 6 or clockwise by a predetermined amount. Therefore, when crank cam 15 is rotated to press first arm 23*a* of rocker arm 23 upward through crank arm 24, the corresponding lift amount is transmitted to VO cam 17 and valve lifter 16 through link rod 25, which has a maximum value Lmax as shown in FIG. 6. Variations in the lift amount from the minimum value Lmin to the maximum value Lmax with the rotational position of control cam 33 provide a characteristic as shown in FIG. 7. Although FIG. 7 shows Lmin as a minimum value close to zero, Lmin can be zero by further rotating control shaft 32 in one direction.

Moreover, ECU 37 determines a target advance-angle amount of intake valve 12 in accordance with information signals derived from various sensors in the same way as described above, based on which passage selector valve 56 carries out communication between first hydraulic passage 54 and main gallery 53 during a predetermined duration and communication between second hydraulic passage 55 and drain passage 57 during a predetermined duration. With this, a relative rotational position between driving shaft 13 and timing sprocket 40 is changed through cylindrical gear 43, achieving control to the advance-angle side. An actual relative rotational position of driving shaft 13 is monitored in advance through lift-phase detecting sensor 59 to rotate driving shaft 13 to a target relative rotational position or target advance-angle amount by means of feedback control.

Specifically, up to a lapse of a predetermined time after engine start, i.e. until the oil temperature reaches a predetermined temperature To, passage selector valve 56 supplies the hydraulic pressure to second hydraulic chamber 50 only, and not to first hydraulic chamber 49. Therefore, cylindrical gear 43 is held in the most forward position by the force of return spring 51 as shown in FIG. 1, having driving shaft 13 held in the rotational position of maximum lag angle. Then, when the oil temperature exceeds predetermined temperature To, passage selector valve 56 is driven based on a control signal derived from ECU 37 and in accordance with the engine operating conditions to continuously change a duration for carrying out communication between first hydraulic passage 54 and main gallery 53 and communication between second hydraulic passage 55 and drain passage 57. Thus, cylindrical gear 43 is moved from the most forward position to the most rearward position, so that, referring to FIG. 7, the opening/closing timing of intake valve 12 is variably controlled from the maximum lag-angle state indicated by solid line to the maximum advance-angle state indicated by broken line. Referring to FIG. 7, vertical line A shows lift phase in the maximum lag-angle position, and vertical broken line A' shows lift phase in the maximum advance-angle position. Therefore, assuming that the lift amount and lift phase are optionally varied by lift-amount varying mechanism 1 and lift-phase varying mechanism 2, respectively, a possible range of lift amount and lift phase is shown by a portion enclosed by lines A, A' and horizontal lines Lmin, Lmax.

As to the positional relationship between intake valve 12 and an exhaust valve opposite thereto and piston, as the lift amount of intake valve 12 becomes greater in the vicinity of TDC, a clearance becomes smaller between intake valve 12 and piston crown face or between intake valve 12 and exhaust valve, rising a problem of interference. With the maximum lift controller by lift-amount varying mechanism 1 and the maximum lag-angle position controlled by lift-phase varying mechanism 2, intake valve 12 does not interfere with the piston in a cylinder and the opposite exhaust valve.

The following explains specific drive control of lift-amount varying mechanism 1 and lift-phase varying mechanism 2 by means of ECU 37.

Figure 8:
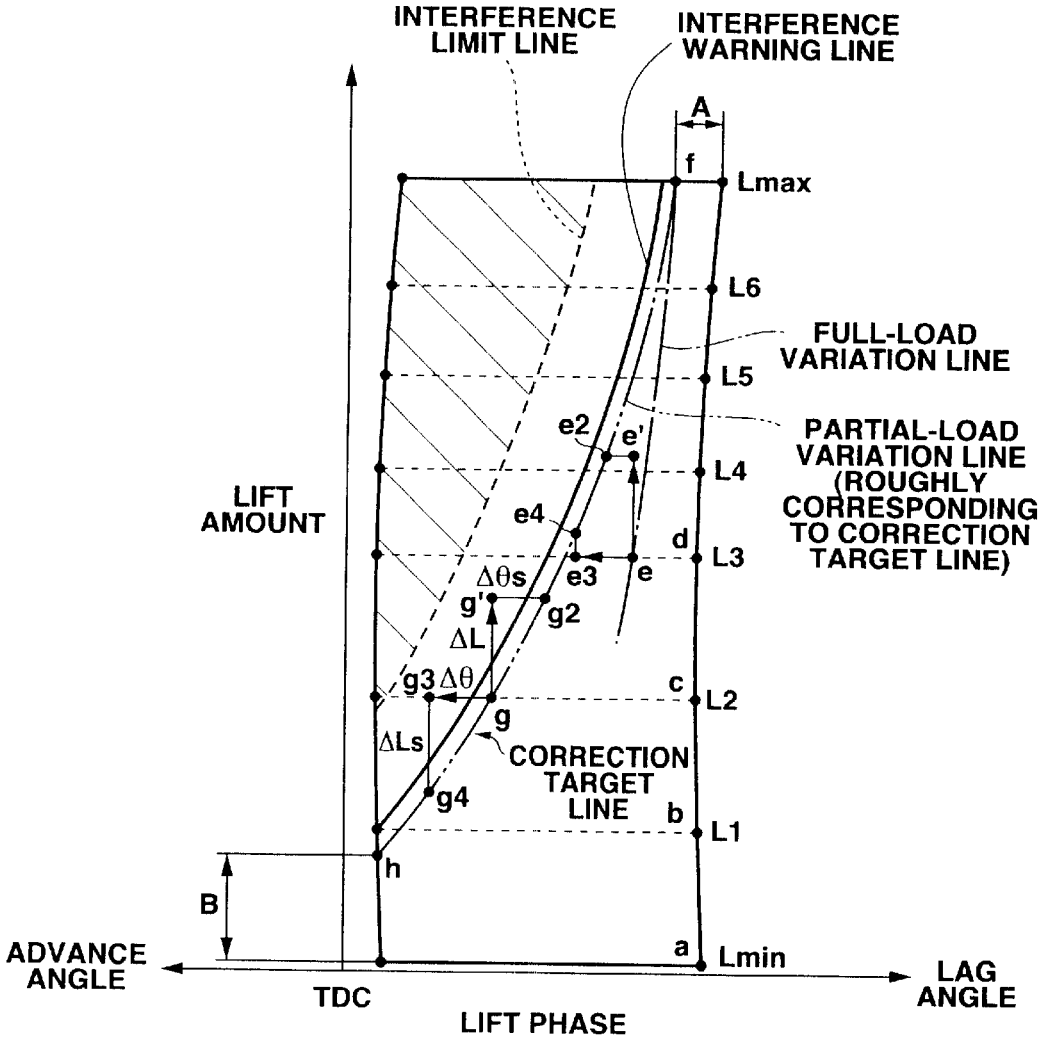
FIG. 8 is a view similar to FIG. 7, showing the characteristics of lift amount vs. lift phase.

Referring to FIG. 8, a portion with oblique line shows an interference area of the component members in the controllable lift-amount and lift-phase range shown in FIG. 7. The boundary forms an interference limit line (shown by broken line). Due to this interference limit line, an interference warning line (shown by solid line) exists on the lag-angle low-lift side. Interference does not occur immediately beyond the warning line, however, in consideration of overshoot so called, the possibility appears to enter the interference producing area. Point "a" in FIG. 8 shows a position controlled to roughly minimum lift amount Lmin at engine start, wherein the cranking rpm builds up quickly because of small valve actuation friction.

With an increase in cranking rpm, required intake-air amount increases. However, since the lift amount increases from Lmin to L3 in accordance with an increase in cranking rpm, excellent startability is obtained.

During this time period, lift-phase varying mechanism 2 is roughly at the maximum lag angle. This is to avoid poor combustion which becomes a problem when the engine is cold by bringing the opening timing of intake valve 12 near the bottom dead center (BDC) for enhancement of the effective compression ratio so called. Within the range of change between points "a" and "d" (vertical direction in FIG. 8), interference may not occur because of sufficient distance from the interference limit line.

Figure 9:
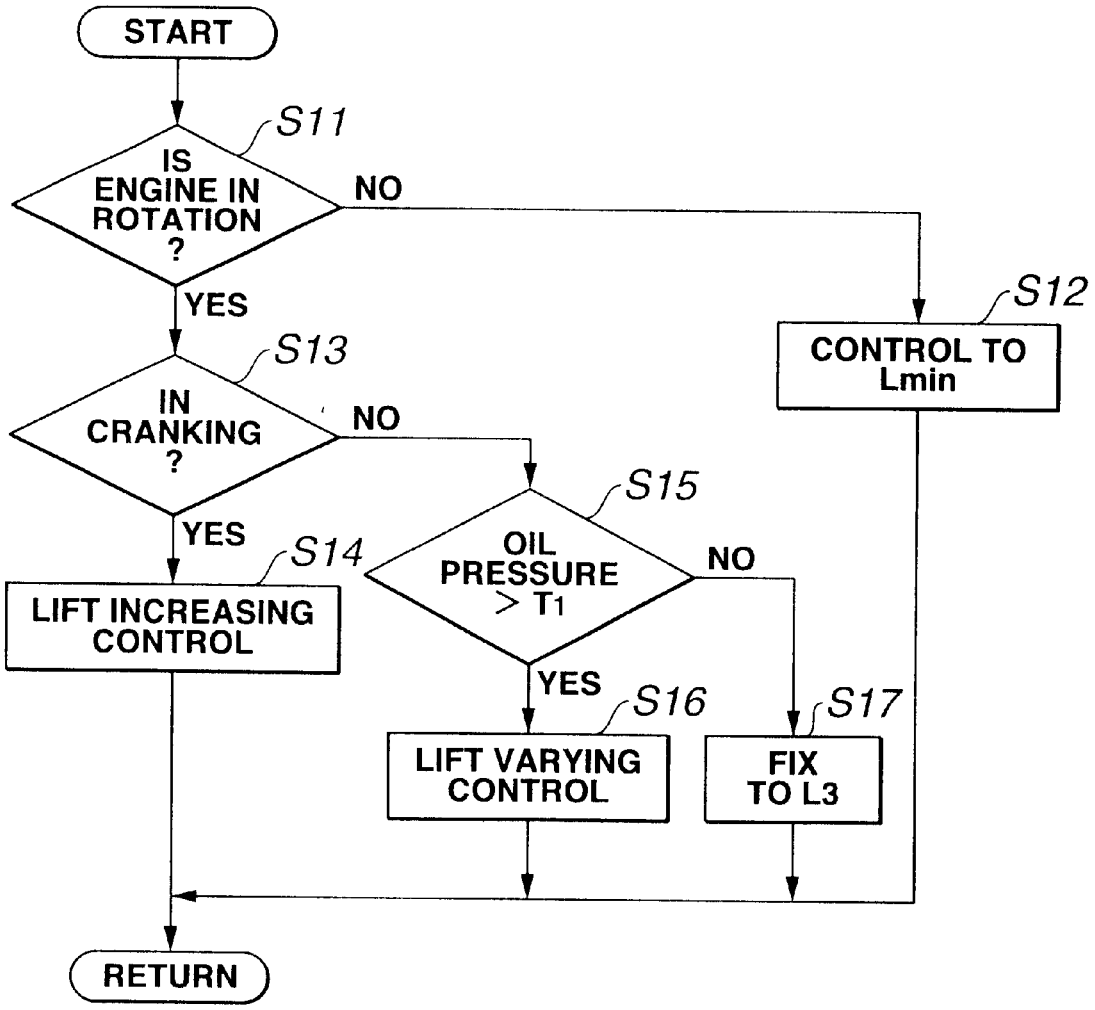
FIG. 9 is a flowchart showing operation of the first embodiment.

Referring to FIG. 9, when the cold engine is warmed up, and the oil temperature exceeds a predetermined temperature T1, control of lift-amount varying mechanism 1 is carried out. Specifically, when an ignition switch is turned on, flow shown in FIG. 9 is started. In a step S11, it is determined whether or not the engine is in rotation. If it is determined that the engine is at a standstill, flow proceeds to a step S12 where lift-amount varying mechanism 1 is controlled to minimum lift Lmin close to zero. In step S11, if it is determined that the engine is in rotation, flow proceeds to a step S13 where it is determined whether or not the engine is in cranking. If it is determined that the engine is in cranking, flow proceeds to a step S14 where with an increase in engine speed or cranking rpm, control of increasing the lift up to a value L3 on solid line in FIG. 7 is carried out by means of lift-amount varying mechanism 1.

In step S13, if it is determined that the engine is not in cranking, flow proceeds to a step S15 where it is determined whether or not the actual oil temperature is higher than predetermined temperature T1 by means of the oil temperature sensor. If it is determined that the oil temperature is higher than T1, flow proceeds to a step S16 where lift varying control is carried out with lift-amount varying mechanism 1 in accordance with the engine operating conditions. In step S15, if it is determined that the oil temperature is lower than or equal to T1, flow proceeds to a step S17 where lift control fixed to L3 is carried out with lift-amount varying mechanism 1. Then, one flow is completed.

In such a way, at the initial time when cranking is started, the lift is controlled to the minimum lift in step S12, providing small friction of the valve actuation system, resulting in quick build-up of engine rotation.

Moreover, lift increasing control in step S14 improves the gas exchange efficiency of air-fuel mixture, achieving quick build-up of engine torque, resulting in greatly improved engine startability in combination with the above quick build-up of engine rotation.

Further, if the oil temperature is lower than T1, the lift is fixed to relatively low lift L3 in step S17, which increases the speed of air-fuel mixture from intake valve 12 to generate strong gas flow in the cylinder, resulting in improved combustion at start in cold engine and in fuel-consumption performance and exhaust emission performance.

Referring to FIG. 8, point "g" shows a control position for a partial load, wherein the lift phase is advanced to near the interference warning line so as to improve the fuel consumption as much as possible, namely, the valve overlap so called is increased to the limit to increase residual gas for reduction in pumping loss. Moreover, in combination with relatively small lift L2, intake valve 12 has sufficiently quick closing timing, achieving a full reduction in pumping loss, resulting in further improved fuel consumption.

Consider the transient state where an abrupt change occurs, for example, from the position of point "b" (lift amount of L1 and lift phase of lag angle) to the position of point "g" (lift amount of L2 and lift phase of advance angle). When having direct movement from point "b" to poing "g", no problem will occur. However, real control is apt to produce the overshoot, which can increase, for example, the lift momentarily up to point "g" higher by ΔL from lift L2, thus exceeding the interference warning line and even the interference limit line. Then, in this embodiment, in such a case, the lift phase is moved to the lag-angle side by a predetermined amount Δθs to come at the lift-phase correction target position of point "g2", preventing shifting to the interference limit line, thus avoiding interference due to overshoot.

Figure 10:
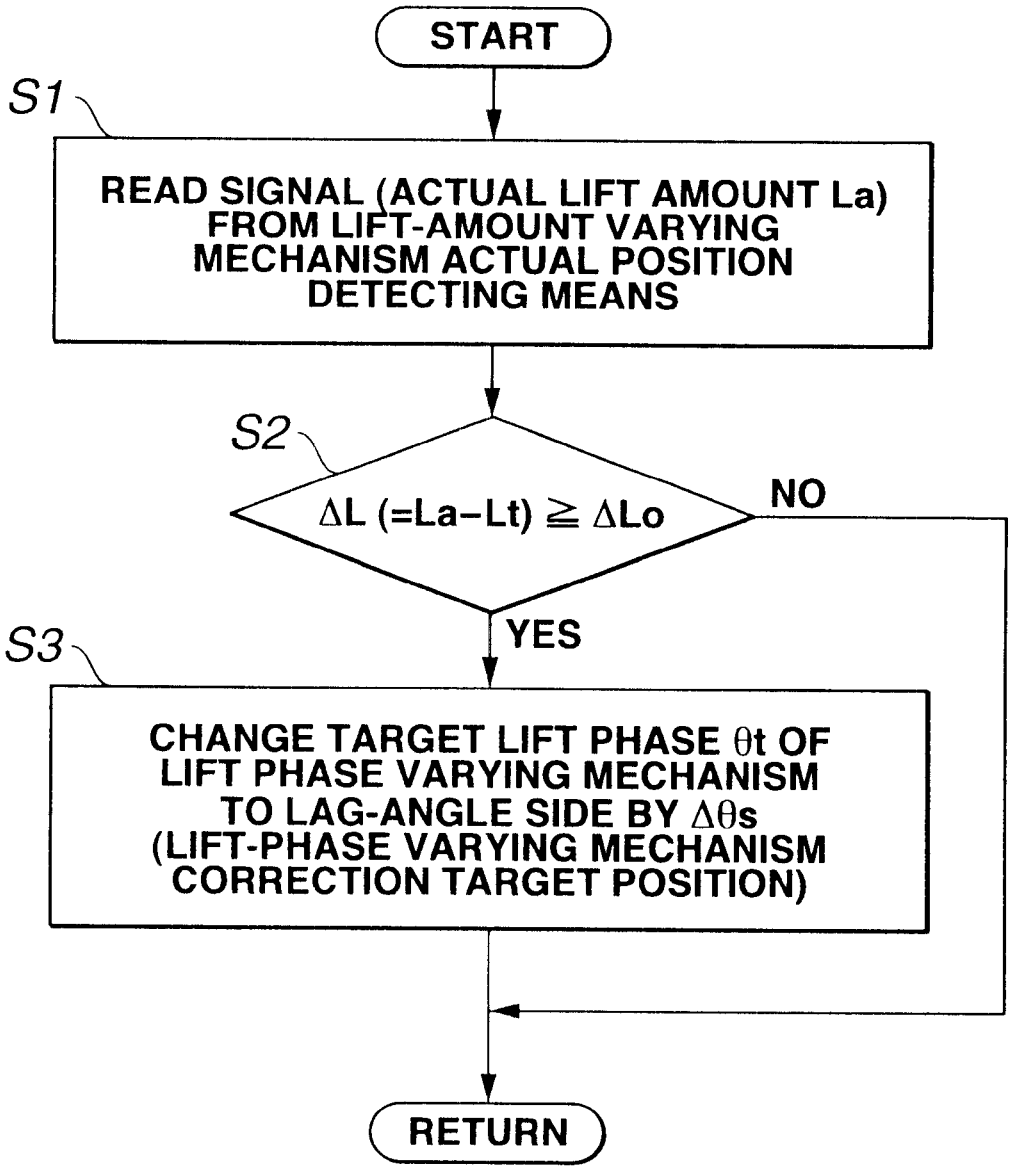
FIG. 10 is a view similar to FIG. 9, showing operation of the first embodiment.

FIG. 10 shows a flowchart of the above control. Since an output signal derived from lift-amount detecting sensor 58 and an actual lift amount are in a one-to-one correspondence, actual lift amount La is determined based on the output signal. First, in a step S1, actual lift amount La is read from lift-amount detecting sensor 58. In a step S2, it is determined whether or not a difference ΔL between actual lift amount La and basic target value Lt is equal to or larger than a predetermined amount ΔLo. If it is determined that ΔL<ΔLo, it is determined that the lift phase may not reach the interference limit line beyond the interference warning line, and flow returns to START. On the other hand, if it is determined that ΔL≧ΔLo, flow proceeds to a step S3 where the lift-phase target value is moved to the lift-phase correction target value (point "g2") on the lag-angle side by a predetermined amount Δ74 s by means of lift-phase varying mechanism 2. This can prevent the lift phase from reaching the interference limit line, thus avoiding interference.

Referring to FIG. 8, two-dot chain line passing through point "g2" forms a correction target line, which can be given on a map, etc.

The above has explained interference preventing control when the lift amount is overshot. Next, control when the lift phase is overshot is explained.

Referring to FIG. 8, in the transient state where the lift amount and lift phase abruptly change, for example, from the position of point "b" (lift amount of L1 and lift phase of lag angle) to the position of point "g" (lift amount of L2 and lift phase of advance angle in a given operation area, interference to be produced when overshoot occurs to the advance angle side by Δθ (point "g3") can be prevented by shifting the lift to the lift-amount correction target position on the smaller lift side by a predetermined amount ΔLs than target lift L2, i.e. point "g4". Two-dot chain line passing through point "g4" forms correction target line.

Figure 11:
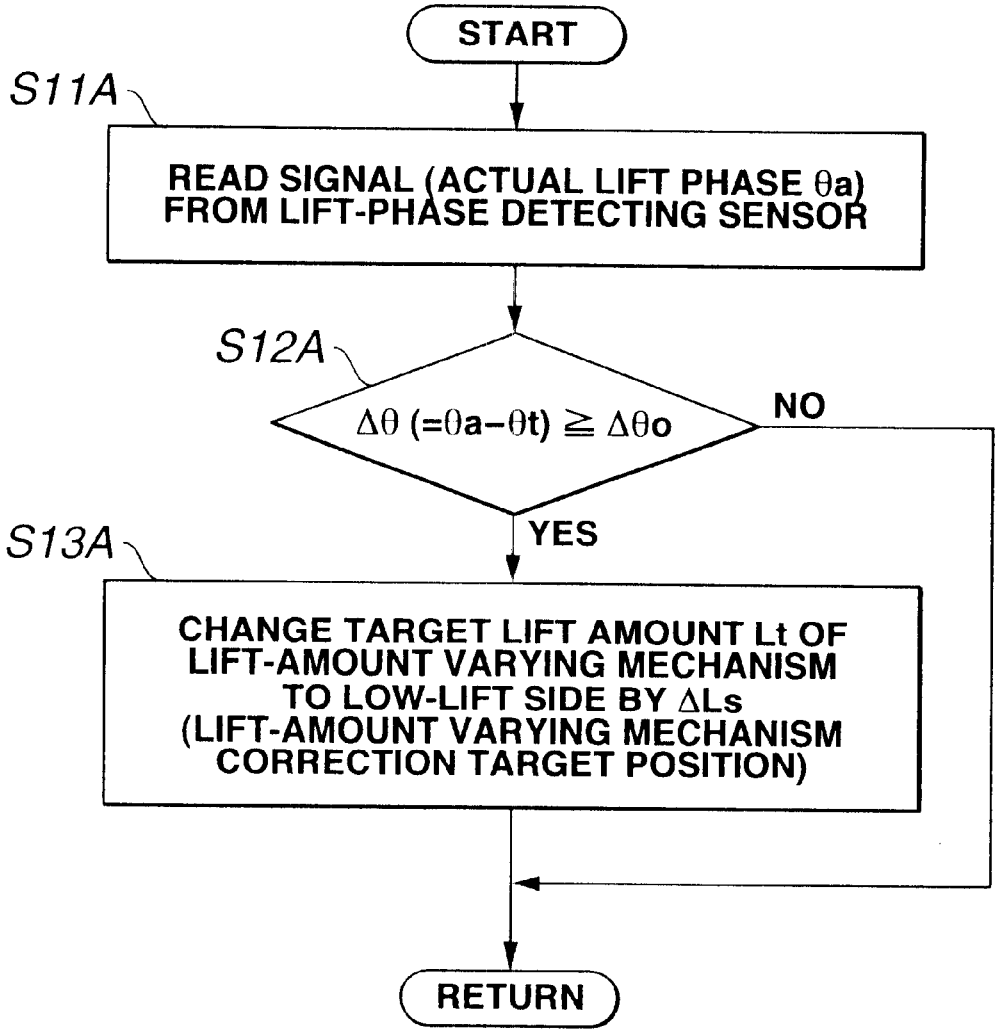
FIG. 11 is a view similar to FIG. 10, showing operation of the first embodiment.

Referring to FIG. 11, this control is explained in accordance with a flowchart. First, in a step S11A, a detection signal or actual lift phase θa which is in a one-to-one relationship with the twist angle of driving shaft 13 is read from lift-phase detecting sensor 59. In a step S12A, it is determined whether or not a difference Δθ between actual lift phase θa and lift-phase target value θt is equal to or larger than a predetermined value Δθo. If it is determined that Δθ<Δθo, flow returns to START because of no possible interference. On the other hand, if it is determined that Δθ≧Δθo, i.e. when the lift phase exceeds the interference warning line, flow proceeds to a step S13A where target lift amount Lt is changed to the lower lift side by correction target lift amount ΔLs, i.e. to point "g4", by means of lift-amount varying mechanism 1. In such a way, lift-amount control can prevent interference between piston and intake valve 12, etc. due to overshoot of the lift phase.

Figure 12:
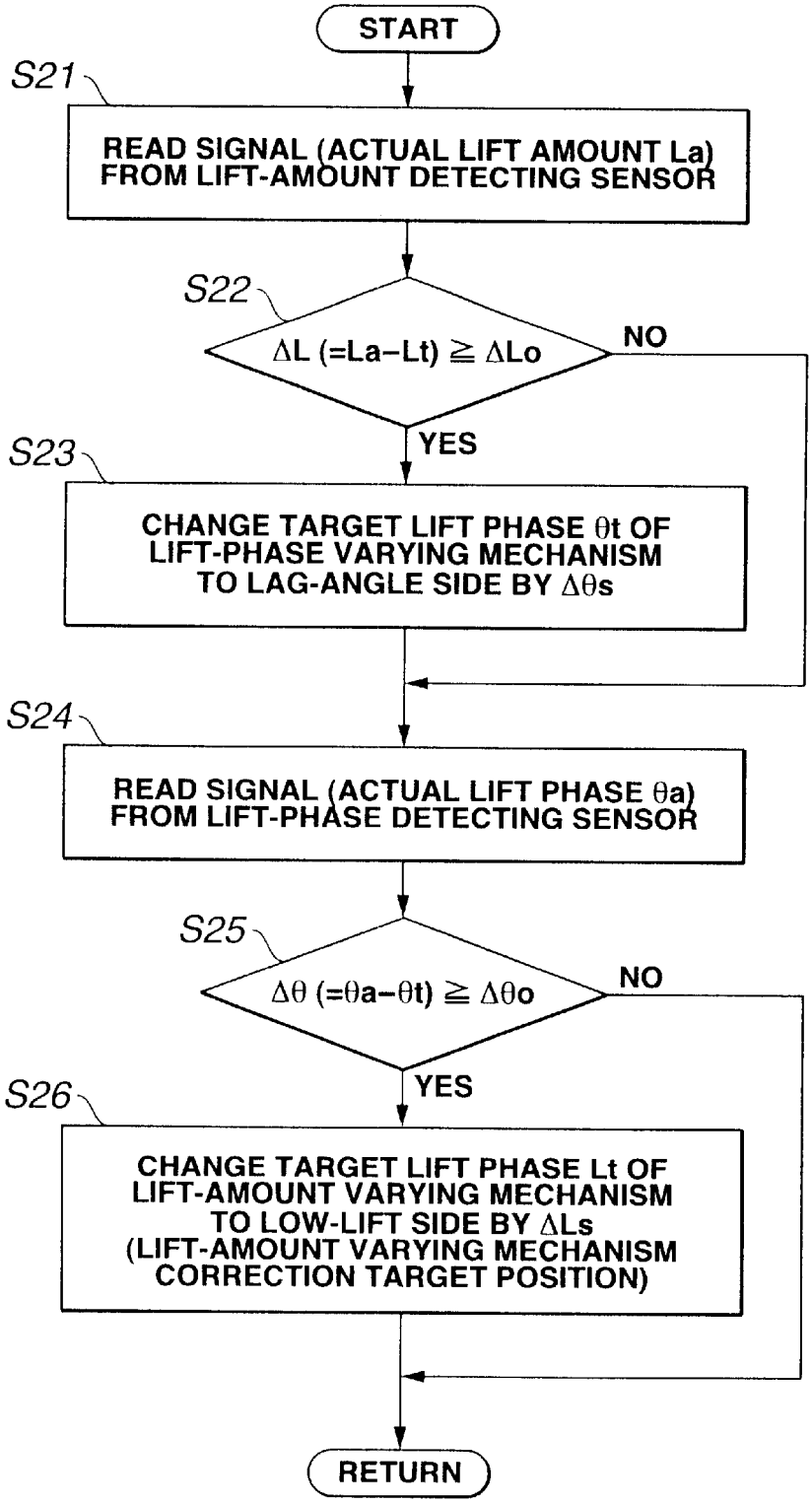
FIG. 12 is a view similar to FIG. 11, showing operation of the first embodiment.

Referring to FIG. 12, control when assuming overshoot of both lift amount and lift phase is explained in accordance with a flowchart. First, in a step S21, an output signal or actual lift amount La is read from lift-amount detecting sensor 58. In a step S22, it is determined whether or not difference ΔL between actual lift amount La and basic target value Lt is equal to or larger than predetermined value ΔLo. If it is determined that ΔL<ΔLo, flow proceeds to a step S24, whereas if it is determined that ΔL≧ΔLo, flow proceeds to a step S23 because of possible interference, where target lift phase θt of lift-phase varying mechanism 2 is changed to the lag-angle side by Δθs, i.e. to the correction target position of lift-phase varying mechanism 2.

In step S24, a detection signal or actual lift phase θa is read from lift-phase detecting sensor 59. In a subsequent step S25, It is determined whether or not difference Δθ between actual lift phase θa and lift phase target value θt is equal to or larger than predetermined value Δθo. If it is determined that Δθ<Δθo, flow returns to START because of no possible interference. On the other hand, if it is determined that Δθ≧Δθo, i.e. when the lift phase exceeds the interference warning line, flow proceeds to a step S26 where target lift amount Lt is changed to the lower lift side by correction target lift amount ΔLs, i.e. to point "g4", by means of lift-amount varying mechanism 1. Then, one flow is completed.

At processing in subsequent flowcharts, if actual lift amount La is larger than new basic target value Lt by Δθo or more in each step, lift-phase correction target value θt is further moved to the lag-angle side by Δθs. Then, actual lift phase θa is read. If θa is shifted to the advance-angle side by Δθo or more with respect to new θt, Lt is controlled to a lift lower by ΔLs. Interference is avoided by repeated execution of such flow.

Referring to FIG. 8, in this embodiment, interference avoiding control effectively functions in an operation area having lift characteristic close to the interference warning line such as partial load area. However, such control is not required per se in an operation area having lift characteristic away from the interference warning line. And if this control is carried out, the engine performance will be deteriorated. Therefore, it is preferable not to carry out interference avoiding control in the operation area having lift characteristic away from the interference warning line, which leads to simplified control and favorable engine performance.

Referring to FIG. 8, one-dot chain line connecting point "t" and point "e" shows a change line at full load. In terms of output torque at full load, it is preferable to increase the lift amount with an increase in engine speed, but not to change the lift phase so much, resulting in such change shown in one-dot chain line. For example, point "e" is sufficiently away from the interference warning line and correction target line, where interference hardly occurs per se. When the change line is moved to point "e" due to overshoot of the lift amount, it is situated on the lift-phase lag-angle side with respect to point "e2" on the correction target line with the same lift amount. Therefore, control on point "e" is situated on the safe side with respect to control on "e2" against interference, and more effective in output torque, maintaining control on point "e", i.e. carrying out control without changing θt to the correction target position, obtaining simplified control.

Figure 13:
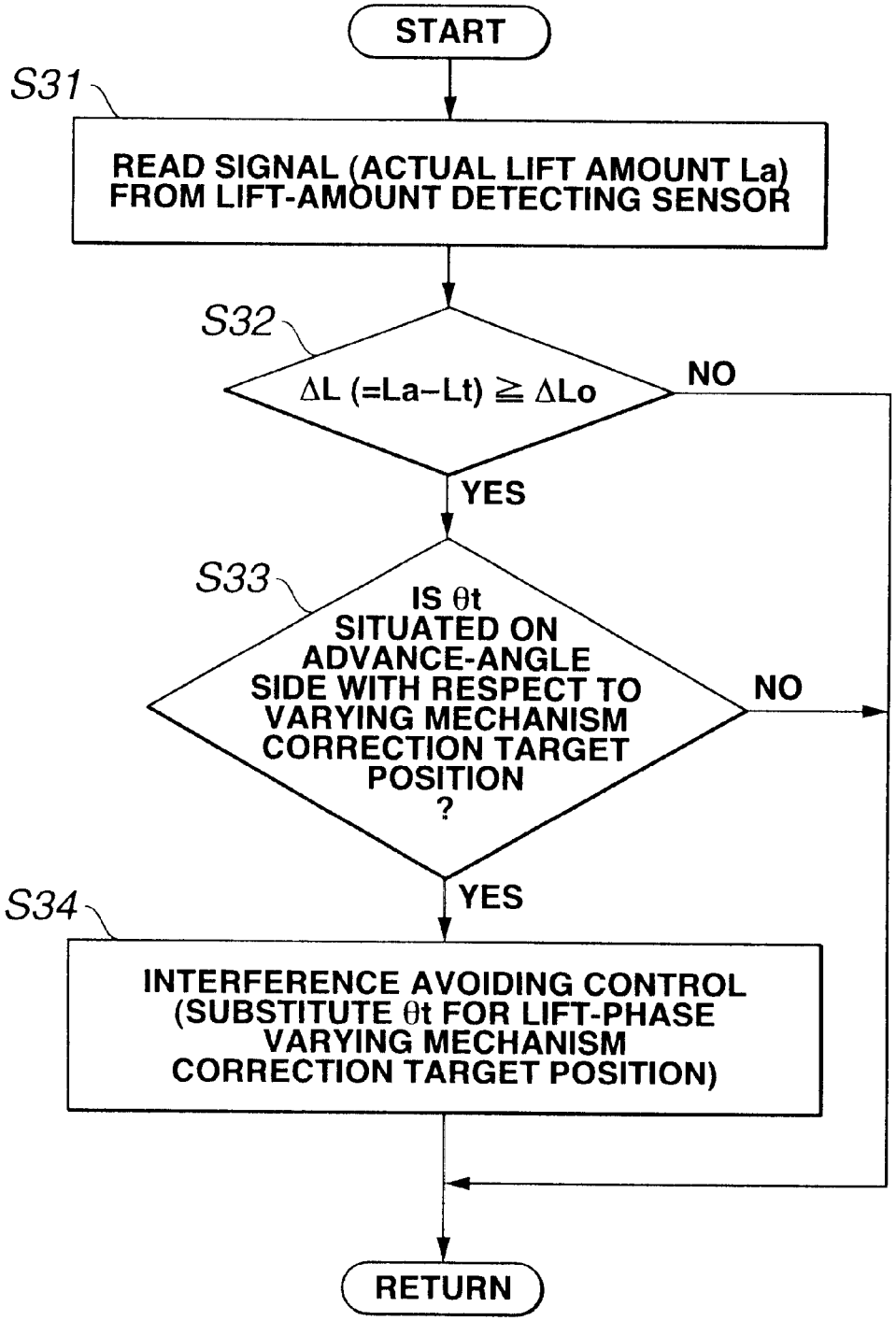
FIG. 13 is a view similar to FIG. 12, showing operation of the first embodiment.

Referring to FIG. 13, the above control is explained in accordance with a flowchart. A correction target line on which interference can be avoided is previously determined on a map, etc. In a step S31, actual lift amount La is read from lift-amount detecting sensor 58. In a step S32, it is determined whether or not difference ΔL between actual lift amount La and basic target value Lt is equal to or larger than a predetermined lift amount ΔLo. If it is determined that ΔL<ΔLo, flow returns to START, whereas if it is determined that ΔL≧ΔLo, flow proceeds to a step S33 where it is determined whether or not actual lift-phase target value θt is situated on the advance-angle side with respect to the lift-phase correction target value (point e2). If it is determined that θt is situated on the advance-angle side, flow proceeds to a step S34 where interference avoiding control, i.e. control of replacing θt with the correction target position, is carried out.

Specifically, even if the overshoot amount exceeds ΔLo during lift-phase control, but if it is on the safe side with respect to the correction line, control is carried out without changing the target value θt, i.e. with the actual target position maintained without using the correction target position. This can avoid interference without interference avoiding control.

When the change line is moved to point "e3" due to overshoot of the lift phase, the lift amount on point "e3" is smaller than that on point "e4" on the correction target line at the same phase. It is thus understood that point "e3" is situated on the safe side against interference. In this case as well, interference is avoided without carrying out interference avoiding control, resulting in favorable engine performance.

Figure 14:
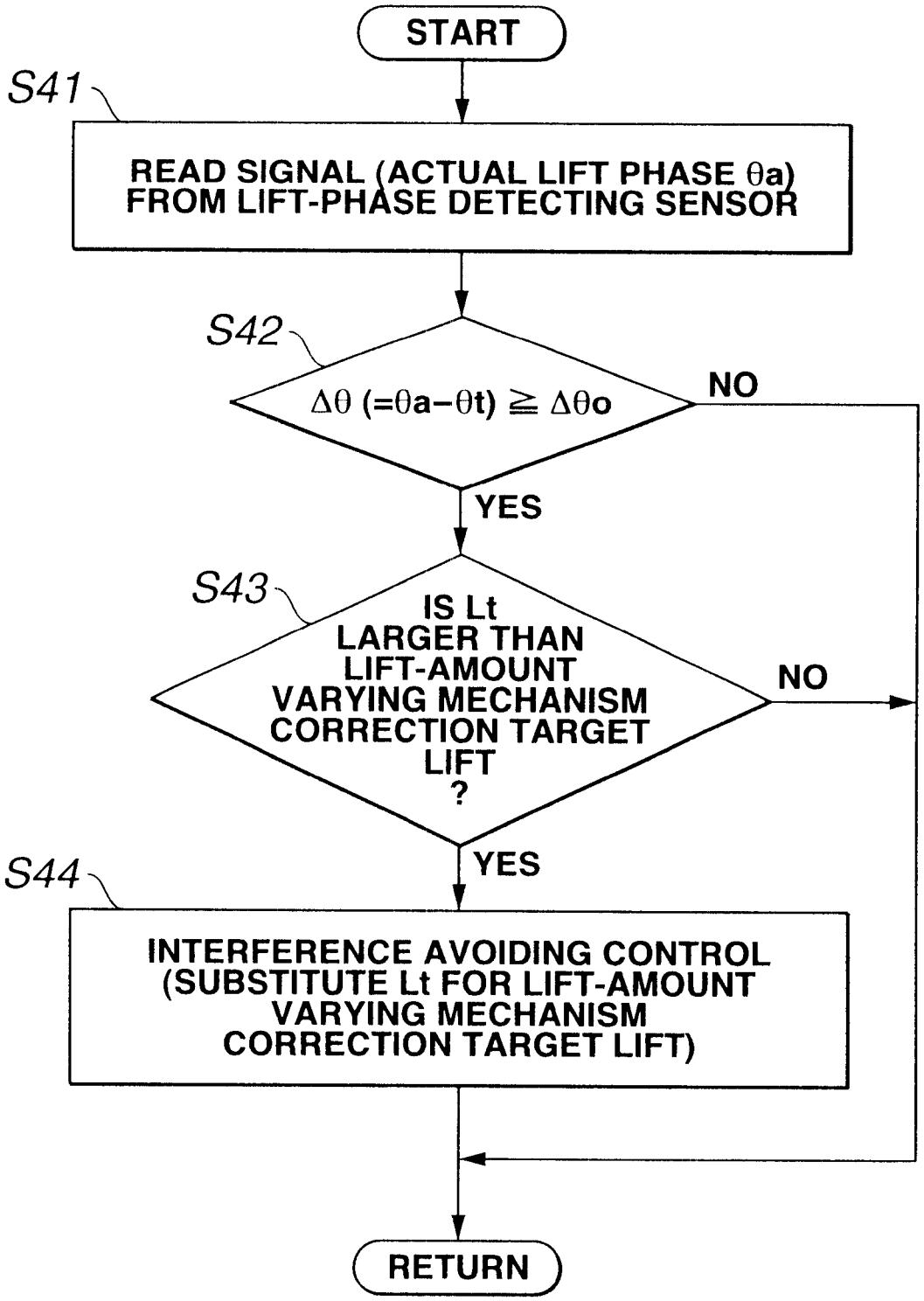
FIG. 14 is a view similar to FIG. 13, showing operation of the first embodiment.

Referring to FIG. 14, the above control is explained in accordance with a flowchart. A correction target line on which interference can be avoided is previously determined on a map, etc. In a step S41, a detection signal of actual lift phase θa is read from lift-phase detecting sensor 59. In a step S42, it is determined whether or not difference Δθ between actual lift phase θa and basic target value θt is equal to or larger than predetermined lift phase Δθo. If it is determined that Δθ<Δθo, flow returns to START, whereas if it is determined that Δθ≧Δθo, flow proceeds to a step S43 where it is determined whether or not actual lift-amount target value Lt is larger than the correction target lift of lift-amount varying mechanism 1. If it is determined that Lt is smaller than the correction target lift, flow returns to START, whereas if it is determined that Lt is larger than the correction target lift, flow proceeds to a step S44 where target lift amount Lt is replaced with the correction target lift of lift-amount varying mechanism 1 to carry out interference avoiding control.

Specifically, even if the overshoot amount of the lift phase exceeds Δθo, but if it is on the safe side with respect to the correction line, target lift amount Lt of the lift-amount varying mechanism 1 is not changed.

The above control with interference avoiding and control without interference avoiding have been explained provided that lift-amount detecting sensor 58 and lift-phase detecting sensor 59 are not in failure. However, in the event of their failure, ECU 37 will not be able to correctly recognize actual lift amount La and actual lift phase θa, leading to frequent occurrence of an interference problem.

In this embodiment, therefore, there are arranged, in addition to detecting sensors 58, 59, auxiliary lift-amount detecting sensor 60 and auxiliary lift-phase detecting sensor 61 to allow prompt detection of a failure of detecting sensors 58, 59 through comparison of the respective corresponding detection signals.

Figure 15:
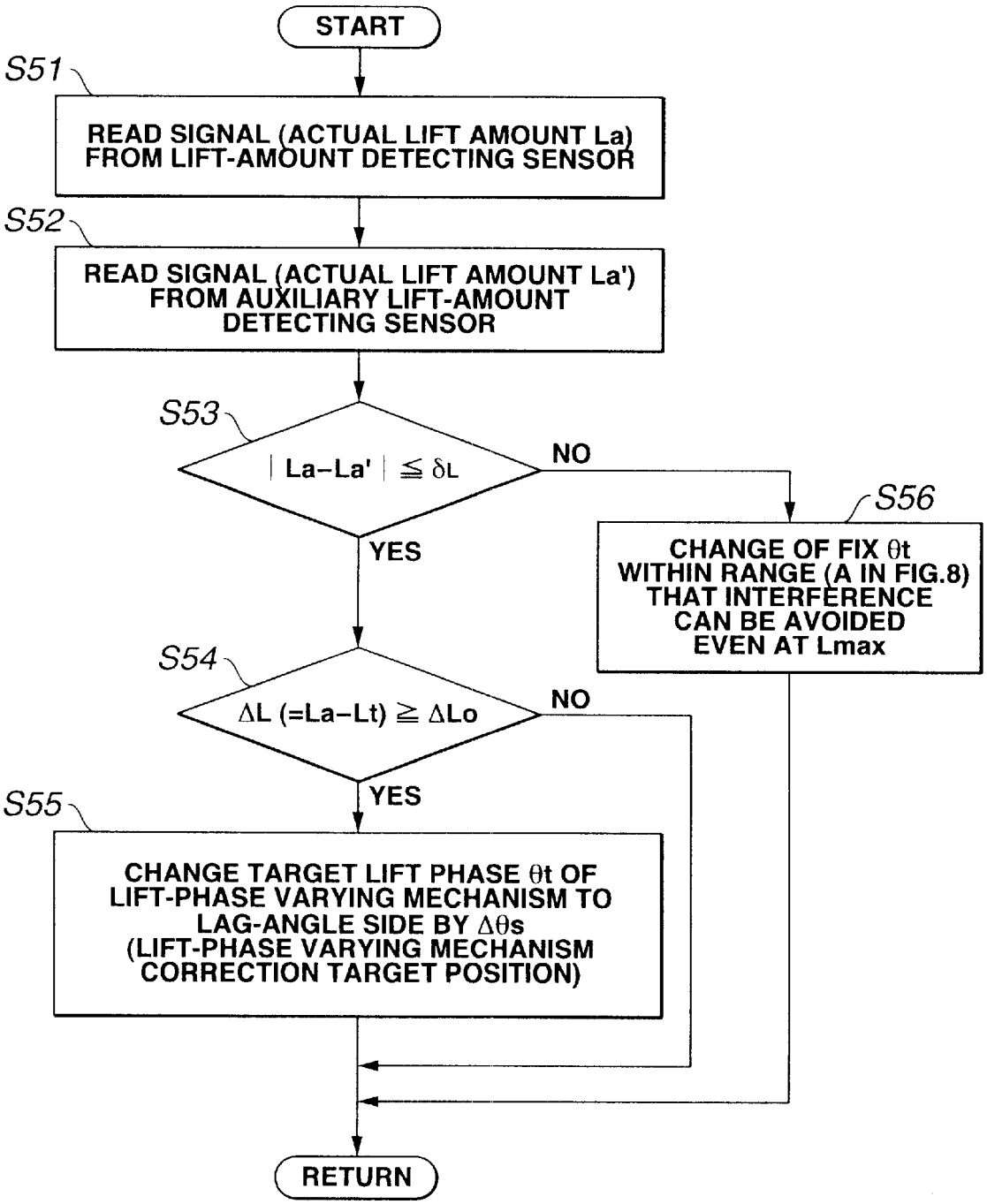
FIG. 15 is a view similar to FIG. 14, showing operation of the first embodiment.

Referring to FIG. 15, control at failure of lift-amount detecting sensor 58 is explained in accordance with a flowchart. First, in a step S51, a detection signal or actual lift amount La is read from lift-amount detecting sensor 58. In a step S52, a detection signal or actual lift amount La' is read from auxiliary lift-amount detecting sensor 60. In step S53, it is determined whether or not a difference between actual lift amounts La and La' is equal to or smaller than a predetermined value δL. If it is determined that |La−La'|≦δL, it is considered that lift-amount detecting sensor 58 is not faulty, and flow proceeds to a step S54 where it is determined whether or not difference ΔL between actual lift amount La and actual lift-amount target value Lt is equal to or larger than predetermined value ΔLo. If it is determined that ΔL<ΔLo, flow returns to START, whereas if it is determined that ΔL≧ΔLo, flow proceeds to a step S55 where target lift phase θt of lift-phase varying mechanism 2 is changed to the lag-angle side by Δθs to carry out interference avoiding control.

On the other hand, in step S53, if it is determined that |La−La'|>δL, lift-amount detecting sensor 58 may be faulty, and flow proceeds to a step S56 where lift phase target value θt is controlled by means of lift-phase varying mechanism 2 within the range A in FIG. 8 given by assuming that the lift amount is maximum lift Lmax, for example. Therefore, even if the lift amount is maximum lift Lmax where interference can occur most frequently, secure avoiding of interference is achieved.

If the lift phase is continuously controlled within the range A, deterioration of the operation performance can be restrained. Moreover, if the lift phase is fixed to the maximum lag angle within the range A, interference can be more securely prevented with control simplified. Further, if the lift phase is fixed approximately in the middle within the range A, deterioration of the operation performance can be restrained to some extent while securely preventing interference with control simplified.

Consider the time required for ECU 37 to determine a failure of lift amount detecting sensor 58 after it occurs. Since the actual position detections by lift-amount detecting sensor 58 and by auxiliary lift-amount detecting sensor 60 are sampled in very short time intervals of about several microseconds, ECU 37 can substantially immediately recognize failure occurrence, thus preventing occurrence of interference due to time lag in recognizing the failure. In addition to interference prevention, knocking due to unmatched ignition timing, emission increase due to unmatched fuel injection quantity, etc. can be immediately prevented.

Figure 16:
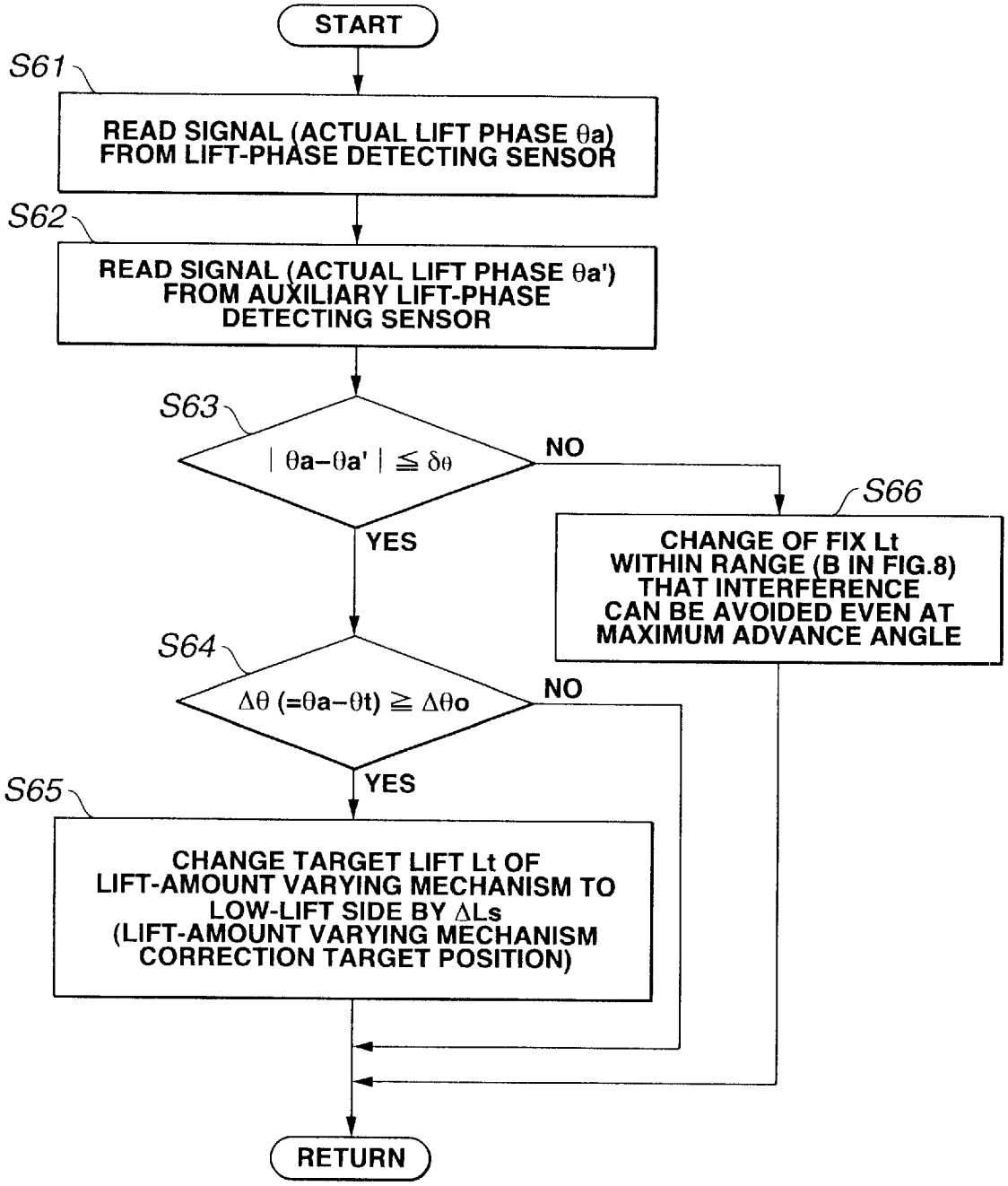
FIG. 16 is a view similar to FIG. 15, showing operation of the first embodiment.

Referring to FIG. 16, control when lift-phase detecting sensor 59 fails is explained in accordance with a flowchart. In a step S61, a detection signal or actual lift phase θa is read from lift-phase detecting sensor 59, and in a step S62, a detection signal or actual lift phase θa' is read from auxiliary lift-phase detecting sensor 61. In a subsequent step S63, it is determined whether or not a difference between actual lift phases θa and θa' is equal to or smaller than predetermined value δθ. If it is determined that |θa−θa'|23 δθ, it is considered that lift-phase detecting sensor 59 is not faulty, and flow proceeds to a step S64 where it is determined whether or not difference Δθ between actual lift phase θa and target lift phase θt is equal to or larger than predetermined value Δθo. If it is determined that Δθ<Δθo, flow returns to START, whereas if it is determined that Δθ≧Δθo, flow proceeds to a step S65 where target lift phase Lt of lift-amount varying mechanism 1 is changed to the low lift side by ΔLs to carry out interference avoiding control.

On the other hand, in step S63, if it is determined that |θa−θa'|>δθ, lift-phase detecting sensor 59 may be faulty, and flow proceeds to a step S66 where lift amount target value Lt is controlled by means of lift-amount varying mechanism 1 within the range B in FIG. 8 even when the lift phase is assumed to be maximum advance angle. Therefore, even if the lift phase is maximum advance angle, interference is securely avoided.

If the lift amount is continuously controlled within the range B, deterioration of the operation performance such as decrease in output torque can be restrained. Moreover, if the lift amount is fixed to minimum lift Lmin within the range B, interference can be more securely prevented with control simplified. Further, if the lift amount is fixed approximately in the middle within the range B, deterioration of the operation performance can be restrained to some extent while securely preventing interference with control simplified.

Consider the time required for ECU 37 to determine a failure of lift-phase detecting sensor 59 after it occurs. Since the actual position detections by lift-phase detecting sensor 59 and by auxiliary lift-phase detecting sensor 61 are sampled in very short time intervals of about several microseconds, ECU 37 can substantially immediately recognize failure occurrence, thus preventing occurrence of interference due to time lag in recognizing the failure. In addition to interference prevention, knocking due to unmatched ignition timing, emission increase due to unmatched fuel injection quantity, etc. can be immediately prevented.

Figure 17:
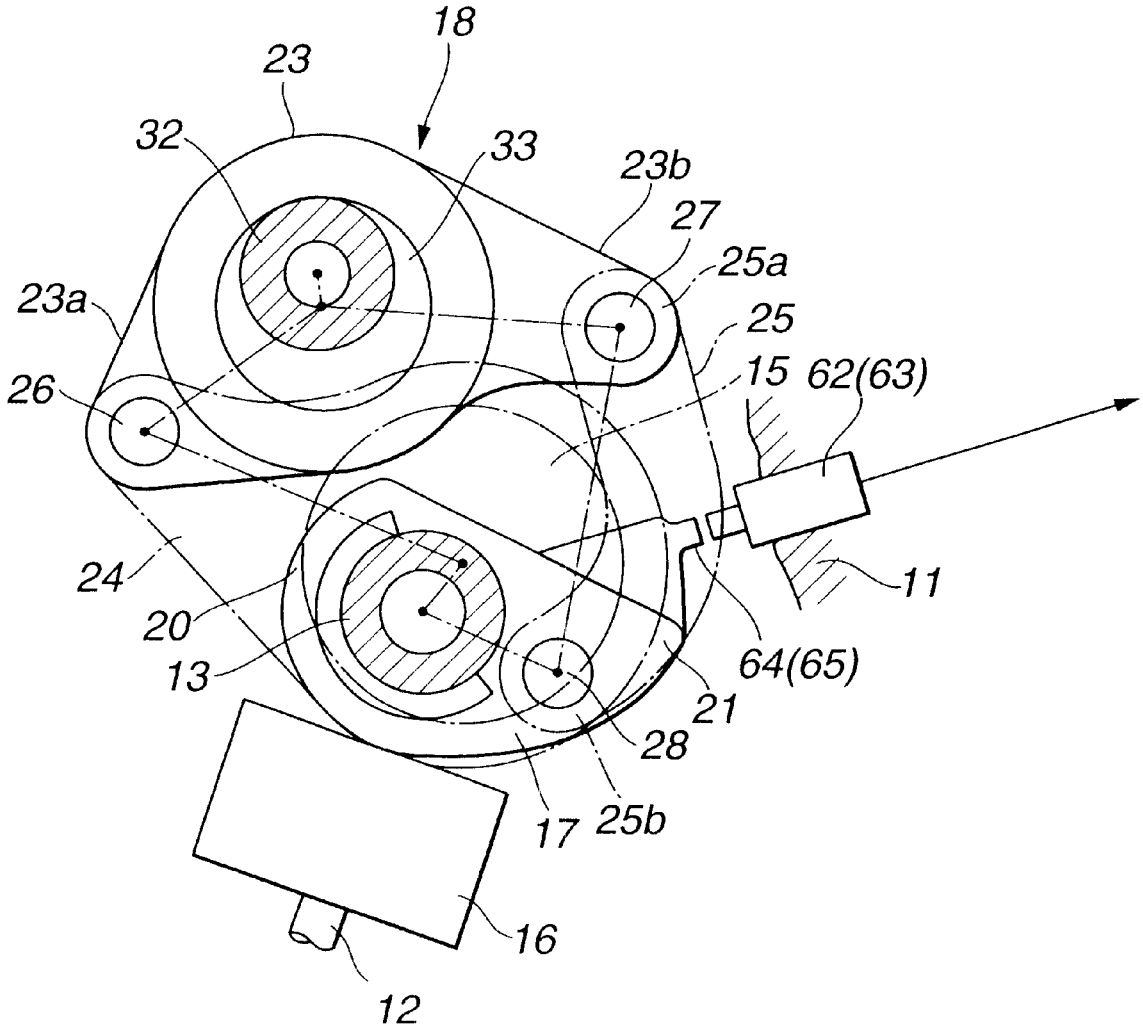
FIG. 17 is a view similar to FIG. 6, taken along the line XVII—XVII, showing a second embodiment of the present invention.
Figure 18:
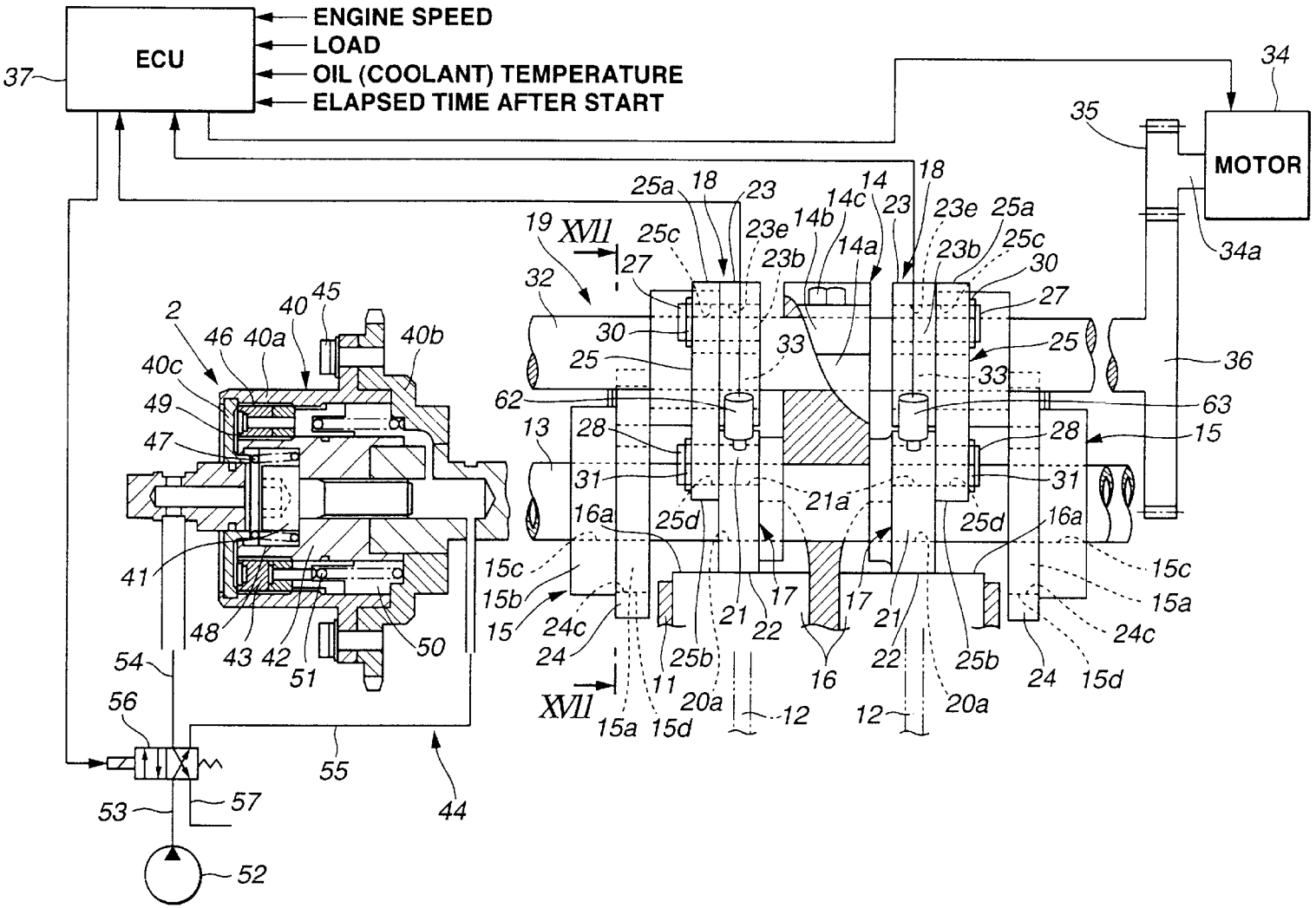
FIG.18 is a view similar to FIG.1, showing the VVA apparatus.

Referring to FIGS. 17–18, there is shown a second embodiment of the present invention, wherein rock-timing sensor 62 and auxiliary rock-timing sensor 63 are arranged to detect through protrusions 64, 65 the timing when VO cams 17, 17 of lift-amount varying mechanism 1 come to a predetermined rocking position or predetermined lift position. Rock-timing sensors 62, 63 are of the non-contact type using Hall element, etc.

Figure 19:
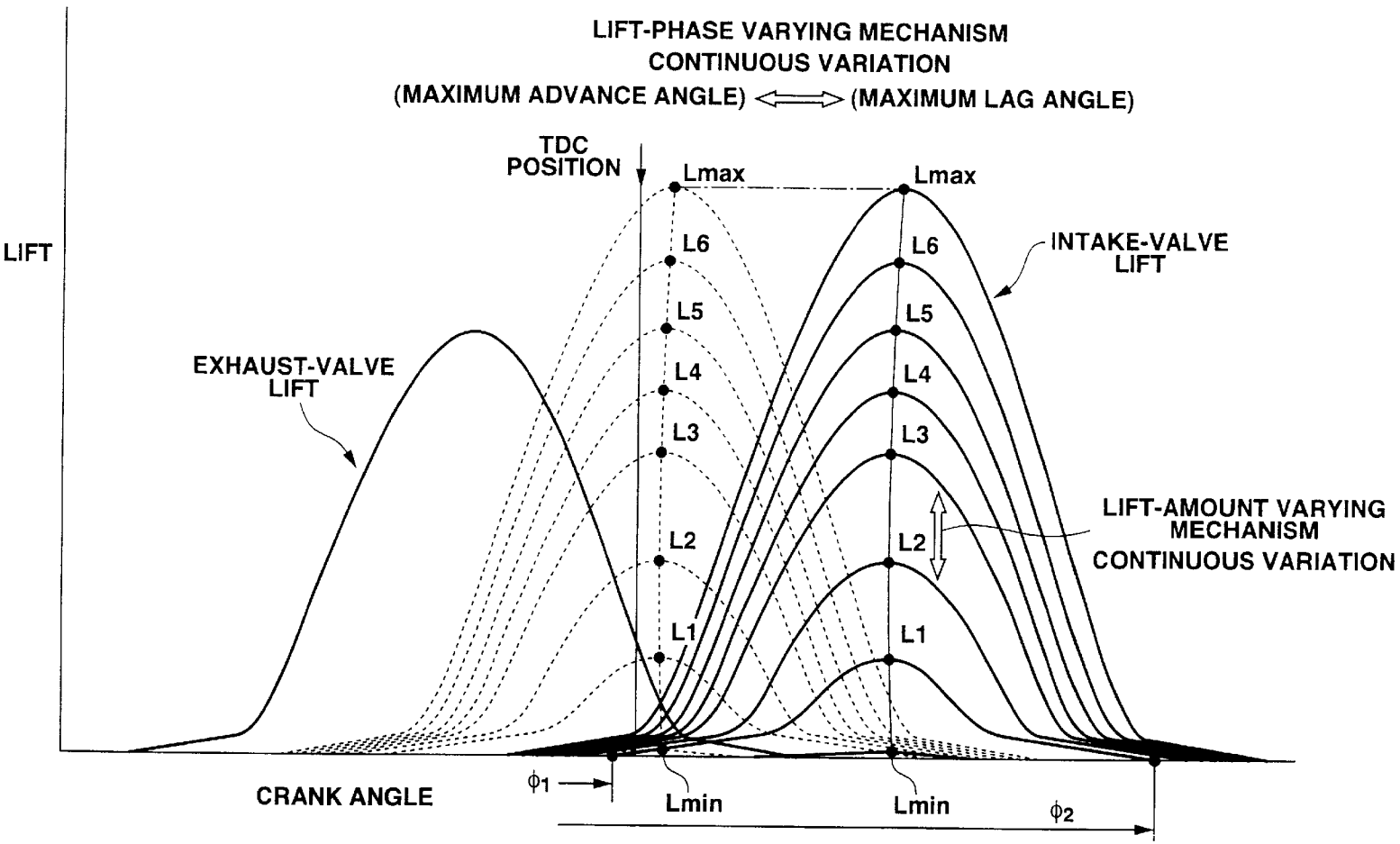
FIG. 19 is a view similar to FIG. 7, showing the characteristics of valve lift vs. crank angle.

Specifically, as shown in FIG. 17, protrusions 64, 65 having roughly the same shape are provided on the top of cam nose 21 of VO cams 17, and rock-timing sensor 62 and auxiliary rock-timing sensor 63 are mounted to cylinder head 11 in the position through which protrusions 64, 65 pass during rocking. In this embodiment, at the instant when both VO cams 17, 17 come to the rocking position where intake valves 12, 12 make lift start or lift end, the position of rock-timing sensors 62, 63 come into agreement with the position of protrusions 64, 65. That is, the lift-start point and lift-end point of intake valves 12, 12 form detection timings. The detected rocking timings occur once on the lift up side (up rocking timing) and once on the lift down side (down rocking timing), and have phases φ1, φ2, φ1', φ2' shifted with respect to the reference crank-angle phase as shown in FIG. 19. The lift amount and lift phase can be obtained based on phases φ1, φ2, φ1', φ2'. This operation is explained in connection with rock-timing sensor 63. The difference φ2−φ1, which indicates a valve opening period, is in a one-to-one correspondence with actual lift amount La, which allows detection of actual lift amount La (L1 in FIG. 19). If φ1 and φ2 are known, actual lift phase θa can be detected by the same rock-timing sensor 63 because θa is located roughly in the intermediate position between φ1 and φ2.

With auxiliary rock-timing sensor 64, since VO cams 17, 17 swing with the same characteristic as that of rock-timing sensor 63, and intake valves 12, 12 lift also with the same characteristic, actual lift amount La' and actual lift phase θa' detected by auxiliary rock-timing sensor 64 ordinarily correspond to actual lift amount La and actual lift phase θa detected by rock-timing sensor 63. If they do not correspond to each other, however, rock-timing sensor 63 may be faulty.

Figure 20:
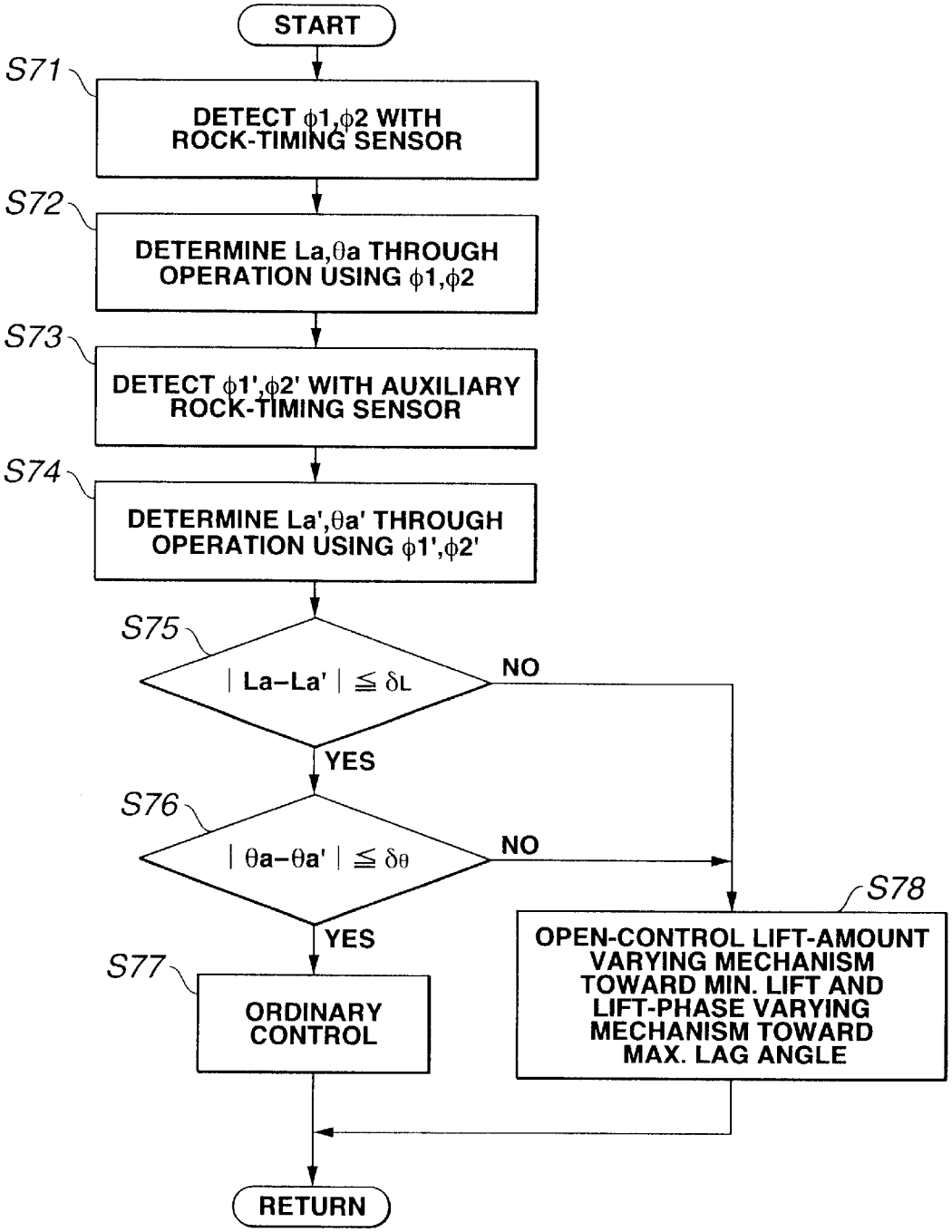
FIG. 20 is a view similar to FIG. 16, showing operation of the second embodiment.

Referring to FIG. 20, this failure detecting control is explained in accordance with a flowchart. In a step S71, phases φ1, φ2 are detected by rock-timing sensor 63, and in a step S72, actual lift amount La and actual lift phase ea are determined based on φ1, φ2 through operation. In a step S73, phases φ1', φ2' are detected by auxiliary rock-timing sensor 64, and in a step S74, actual lift amount La' and actual lift phase θa' are determined based on φ1', φ2' through operation. In a subsequent step S75, it is determined whether or not a difference between actual lift amounts La and La' is equal to or smaller than predetermined value δL. If it is determined that |La−La'|>δL, there is no possibility of failure, and thus flow proceeds to a step S76 where it is determined whether or not a difference between actual lift phases θa and θa' is equal to or smaller than predetermined value δθ. If it is determined that |θa−θa'|>δθ, there is no possibility of failure, and thus flow proceeds to a step S77 where ordinary lift control is carried out.

On the other hand, in steps S75, S76, if it is determined that the differences are larger than respective predetermined values δL, δθ, the possibility of failure is high, and thus flow proceeds to a step S78 where open control is carried out toward the minimum lift by lift-amount varying mechanism 1 and toward the maximum lag angle by lift-phase varying mechanism 2. This allows secure avoiding of interference between the piston and intake valve 12, etc. The reason why open control is carried out to the safe side by both changing mechanisms 1, 2 is that not only the La recognition, but also the ea recognition may be wrong when rock-timing sensor 63 fails.

In such a way, in this embodiment, failure detection, etc. can be carried out with only two sensors 63, 64, achieving simplified system configuration, resulting in improved manufacturing and assembling efficiency and reduced manufacturing cost.

Moreover, in this embodiment, rock-timing sensor 63 and auxiliary rock-timing sensor 64 are provided to the same cylinder. Optionally, they may be provided to separate and distinct cylinders.

The use of actual lift amount La' and actual lift phase θa' detected by auxiliary rock-timing sensor 64 not only for failure detection, but also for ordinary feedback control provides improved control accuracy in the same way as to shorten sampling interval. Moreover, even under such circumstances that auxiliary rock-timing sensor 64 is used for control, a failure of rock-timing sensor 63 can be detected from comparison between actual lift amount La and actual lift phase θa detected by rock-timing sensor 63 through the same control as that in FIG. 20.

Figure 21:
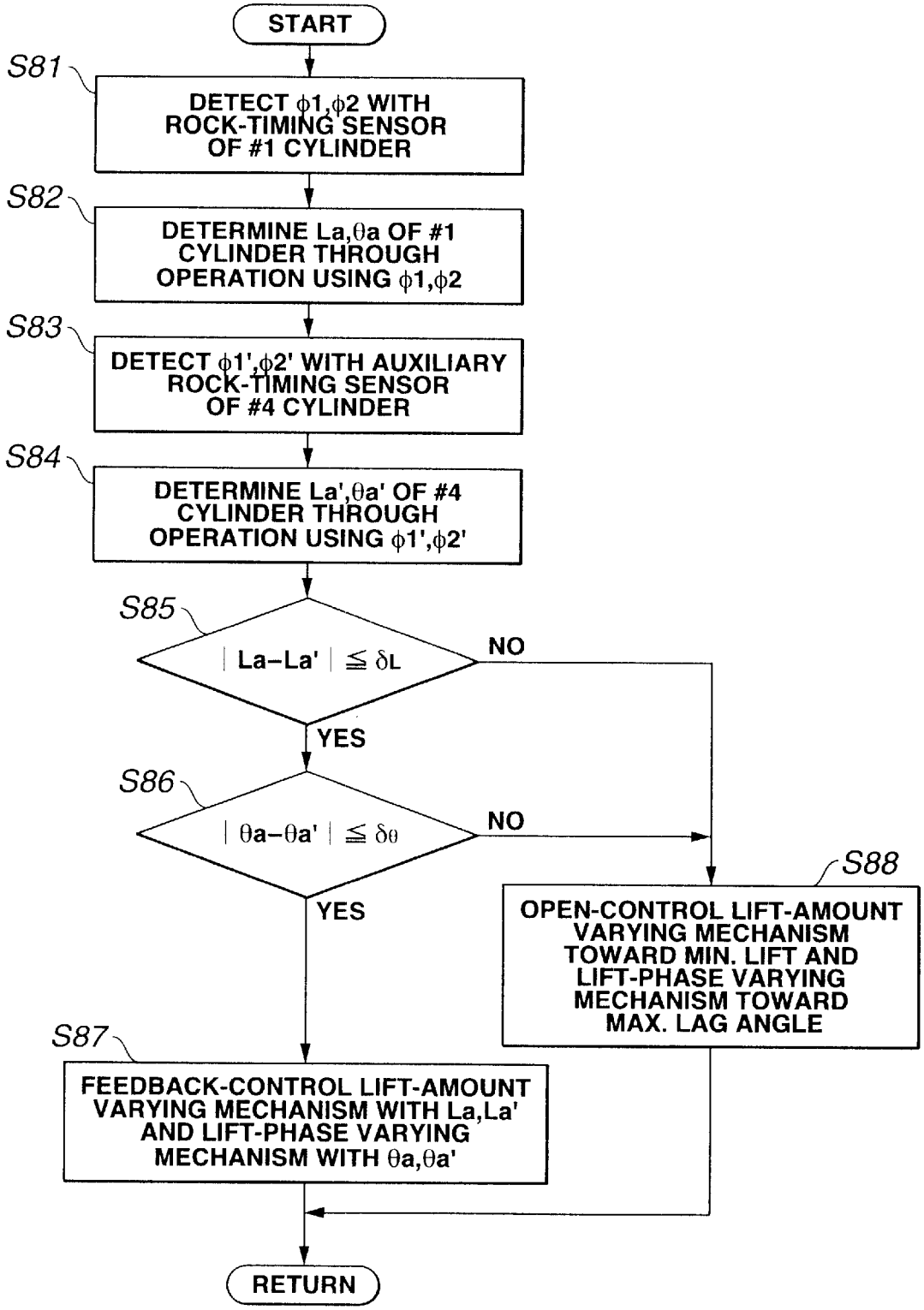
FIG. 21 is a view similar to FIG. 20, showing operation of the second embodiment.

Referring to FIG. 21, this control is explained in accordance with a flowchart. First, in steps S81 and S82, actual lift amount La and actual lift phase θa of No. 1 (#1) cylinder are determined based on phases ϕ1, ϕ2 detected by rock-timing sensor 63 provided to #1 cylinder. In steps S83 and S84, actual lift amount La' and actual lift phase θa' of #4 cylinder are determined based on phases ϕ1', ϕ2' detected by auxiliary rock-timing sensor 64 provided to #4 cylinder. Since the ignition sequence is #1-#3-#4-#2, detection is carried out at an equal interval. In steps S85 and S86, differences between La and La' and between θa and θa' are checked. If it is determined that the differences are smaller than respective predetermined values δL, δθ, there is no failure, and thus flow proceeds to a step S87 where feedback control of lift-amount varying mechanism 1 is carried out based on actual lift amounts La, La', and ordinary feedback control of lift-phase varying mechanism 2 is carried out based on actual lift phases θa, θa'.

In steps S85, S86, if it is determined that the differences are equal to or larger than predetermined values δL, δθ, rock-timing sensor 63 may be faulty in the same way as in FIG. 20, and thus flow proceeds to a step S88 where lift-amount varying mechanism 1 and lift-phase varying mechanism 2 are open controlled toward the minimum lift and the maximum lag angle, respectively.

As described above, if it is determined that no failure occurs, sampling of detection on actual lift amounts includes La' of #4 cylinder in addition to La of #1 cylinder, which is an equivalence of substantially ½ reduction in sampling interval, resulting in improved accuracy of feedback control of lift-amount varying mechanism 1. Likewise, sampling of detection on actual lift phases includes θa' of #4 cylinder in addition to θa of #1 cylinder, which is an equivalence of substantially ½ reduction in sampling interval, resulting in improved accuracy of feedback control of lift-phase varying mechanism 2.

In the aforementioned embodiments, interference avoiding control is explained with regard to the case that both lift-amount varying mechanism 1 and lift-phase varying mechanism 2 are provided to intake valve 12. The same interference avoiding control is applicable when they are provided to the exhaust valve 12. In the latter case, a unfavorable direction for interference approaching TDC is the lag-angle side.

Referring to FIGS. 22–27, there is shown a third embodiment of the present invention which is substantially same in structure except that lift-amount varying mechanism 1 and lift-phase varying mechanism 2 are provided with mechanical-switch mechanisms, respectively.

In this embodiment, as shown in FIGS. 23A–23D, lift-amount varying mechanism 1 is provided with a first mechanical-switch mechanism 70 which comprises a bracket 71 for receiving and rotatably supporting an end of control shaft 32, a mechanical-switch ring 73 rotatably engaged with the outer peripheral surface of a tubular portion 72 integrally formed with the front end face of bracket 71 at the edge of a through hole 71*a*, a ring-rotation pin 74 radially protruding from the periphery of the end of control shaft 32 and engaged with a lever 73*a* axially protruding from the outer peripheral edge of ring 73 for rotation thereof, a torsion coil spring 76 wound around tubular portion 72 and having one end 76*a* engaged with an engagement portion 75 on the front face of bracket 71 and another end 76*b* engaged with lever 73*a*, and an annular plate 77 interposed between a flange 32*a* provided on the periphery of the end of control shaft 32 and torsion coil spring 76 for restraining movement of spring 76.

Bracket 71 is provided on its front end face with a push switch 78 on which lever 73*a* abuts, and tubular portion 72 is provided on its front end with three stopper pins 79 for stopping plate 77.

Figure 24:
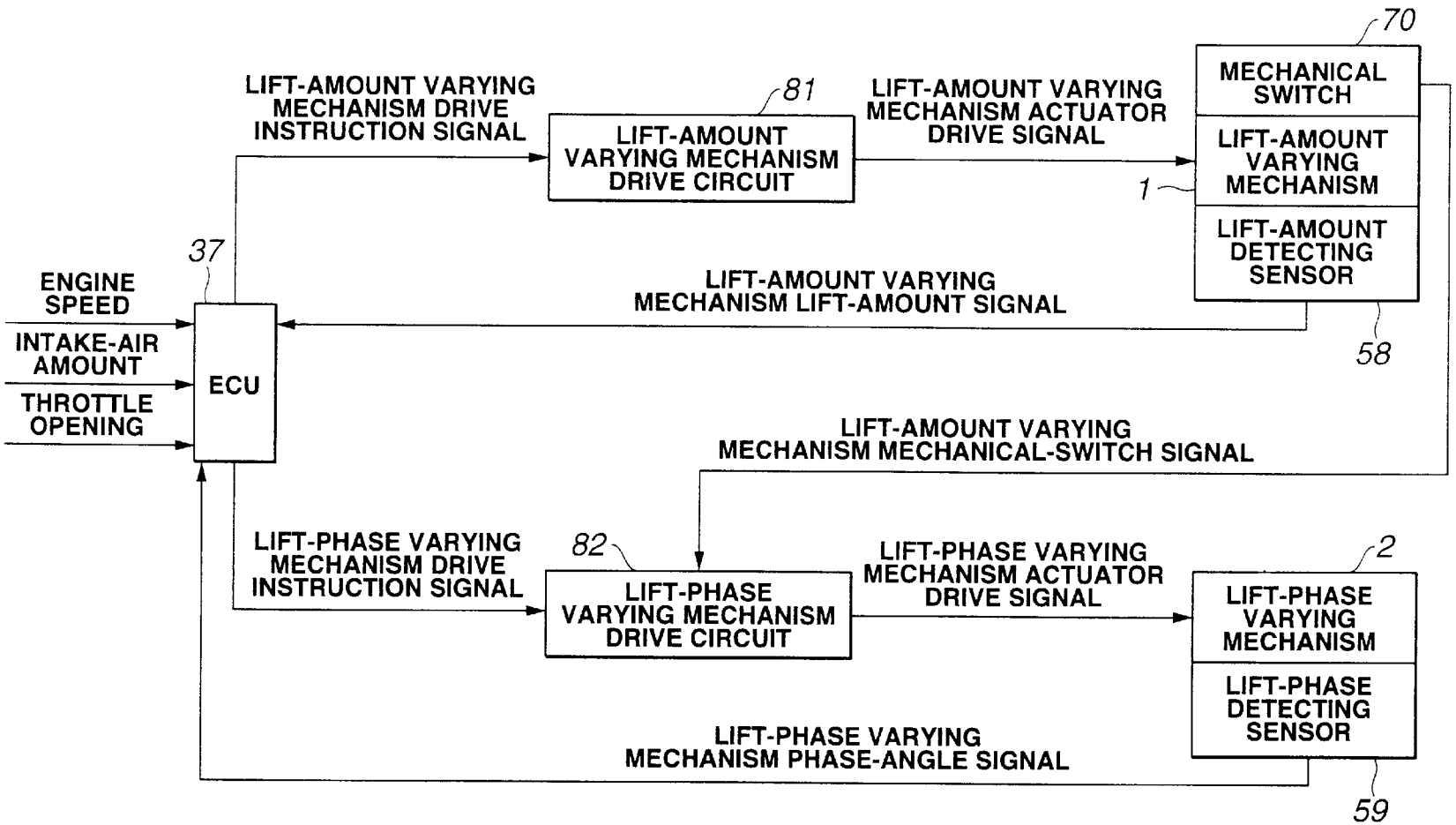
FIG. 24 is a block diagram showing control in the third embodiment.
Figure 25:
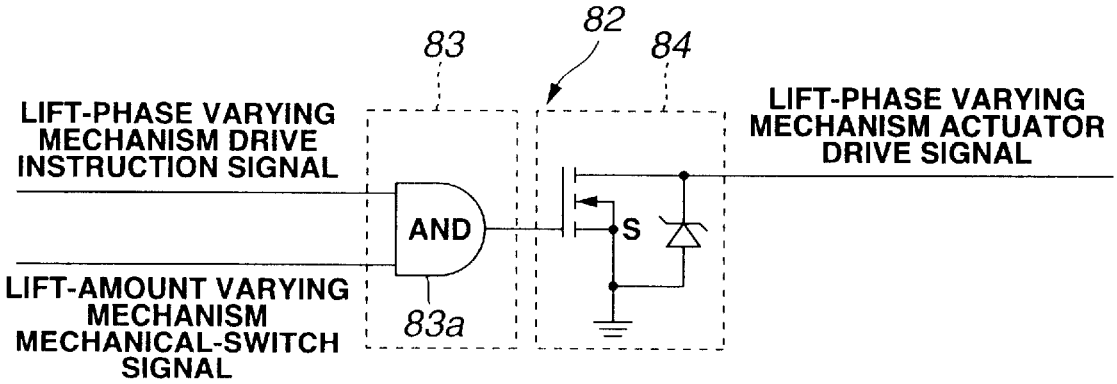
FIG. 25 is a diagram showing a drive circuit for the lift-amount varying mechanism.

Provided on the rear side of bracket 71 is a mechanical-switch circuit 80 which receives on/off signals from push switch 78 and provides them to a drive circuit 82 of lift-phase varying mechanism 2 as shown in FIGS. 24–25. Circuit 80 comprises a relay switch 80*a* of the normally closed contact type, a resistor 80*b*, etc. When push switch 78 is turned off, the contact of relay switch 80*a* is turned on to provide power voltage to a switch-state detecting part for recognition of the on state, whereas when push switch 78 is turned on, the contact of relay switch 80*a* is turned off to provide the ground (GND) to the switch-state detecting part for recognition of the off state.

Figure 22:
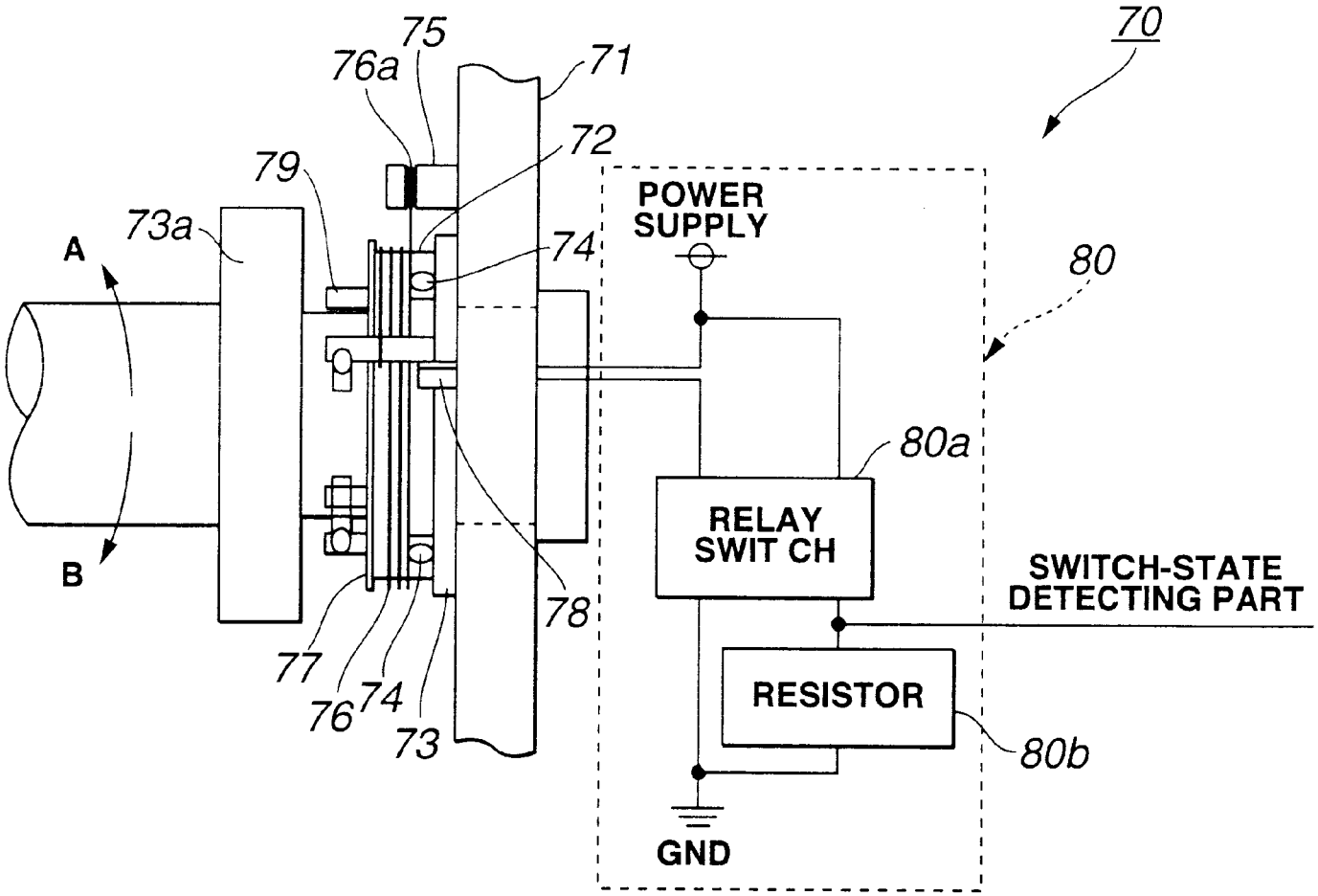
FIG. 22 is a fragmentary side view showing a third embodiment of the present invention.
Figure 23A:
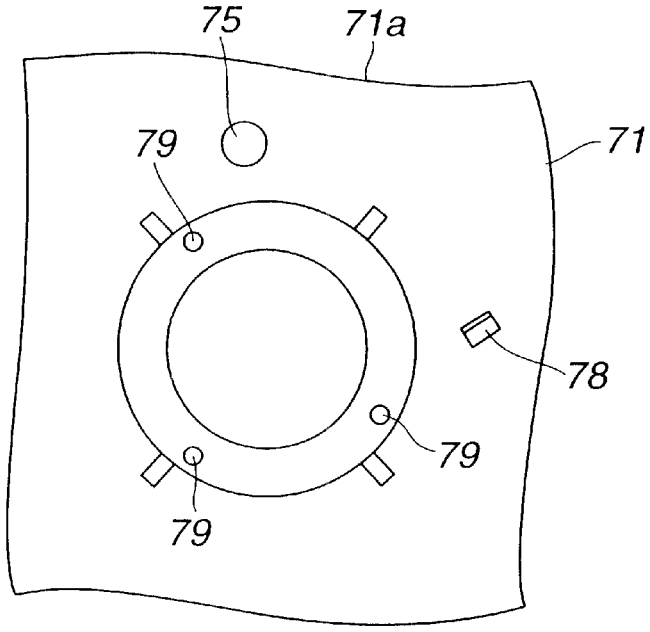
FIG. 23A is a fragmentary front view showing a bracket of a mechanical-switch mechanism.
Figure 23B:
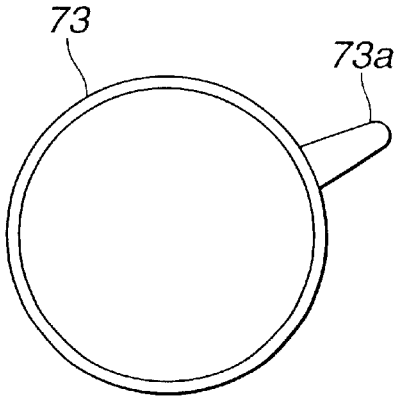
FIGS. 23B–23D are front views showing a mechanical-switch ring, a torsion coil spring, and a plate, respectively.
Figure 23C:
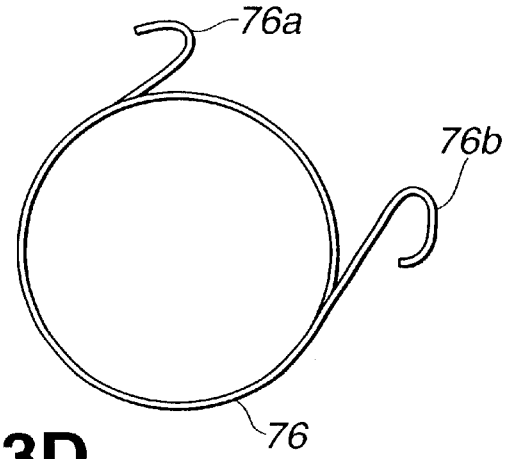
Figure 23D:
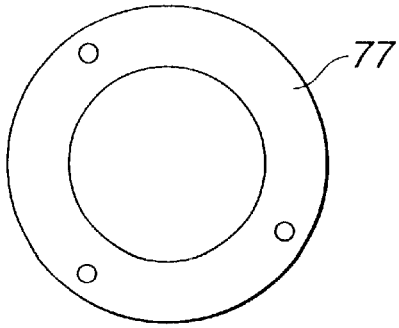

The following briefly explains operation of mechanical-switch mechanism 70. Referring to FIG. 22, when control shaft 32 rotates in the direction of arrow A, the valve lift amount is decreased, whereas when it rotates in the direction of arrow B, the valve lift amount is increased. When control shaft 32 rotates in the direction of arrow B, ring-rotation pin 74 separates from lever 73*a* of mechanical-switch ring 73. At that time, as being rotated in the direction of arrow B by the force of torsion coil spring 76, ring 73 abuts on push switch 78 to always put it in the on state.

On the other hand, when control shaft 32 is rotated in the direction of arrow A by a predetermined amount, ring-rotation pin 74 abuts on lever 73*a* of mechanical-switch ring 73 to rotate it in the direction of arrow A, so that lever 73*a* separates from push switch 78 to turn it off. The mounting position of ring-rotation pin 74 is so determined that push switch 78 is turned on and off at a valve lift amount where it is desired to turn on and off mechanical-switch circuit 80.

FIG. 24 is a block diagram showing control of ECU 37 for lift-amount varying mechanism 1 and lift-phase varying mechanism 2. As described above, ECU 37 for determining the engine operating conditions based on information signals derived from the sensors outputs control signals to a lift-amount varying mechanism drive circuit 81 and a lift-phase varying mechanism drive circuit 82, thus outputting drive signals to the actuators of varying mechanisms 1, 2. Moreover, ECU 37 outputs the control signals based on feedback signals derived from lift-amount detecting sensor 58 and lift-phase detecting sensor 59. Signals derived from mechanical-switch mechanism 70 are provided to lift-phase varying mechanism drive circuit 82.

Specifically, referring to FIG. 25, the signals derived from mechanical-switch circuit 80 of mechanical-switch mechanism 70 are inputted, together with drive instruction signals for lift-phase varying mechanism 2, to an AND circuit 83*a* which constitutes a logic circuit 83. Then, via a drive-circuit part 84, they are outputted as actuator drive signals for lift-phase varying mechanism 2.

In this embodiment, therefore, when control shaft 32 rotates in the direction of arrow A in FIG. 22 in accordance with the engine operating conditions, i.e. in the case of small lift control, push switch 78 is turned off, so that mechanical-switch circuit 80 outputs a on signal to logic circuit 83. As for the drive instruction signal for lift-phase varying mechanism 2, a on signal is outputted to logic circuit 83, allowing sufficient control to the advance-angle side without restricting control of lift-phase varying mechanism 2.

Figure 26:
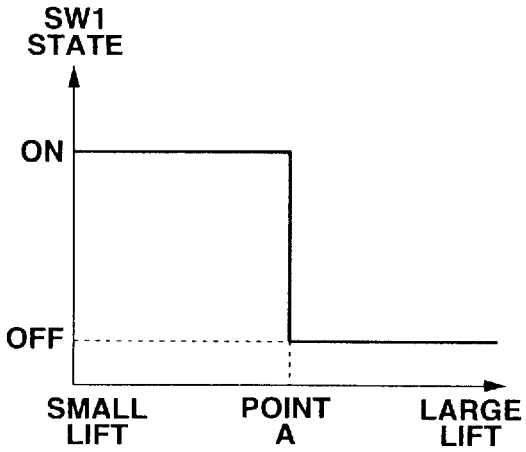
FIG. 26 is a view similar to FIG. 19, showing the on-off switching characteristics of the mechanical-switch mechanism.
Figure 27:
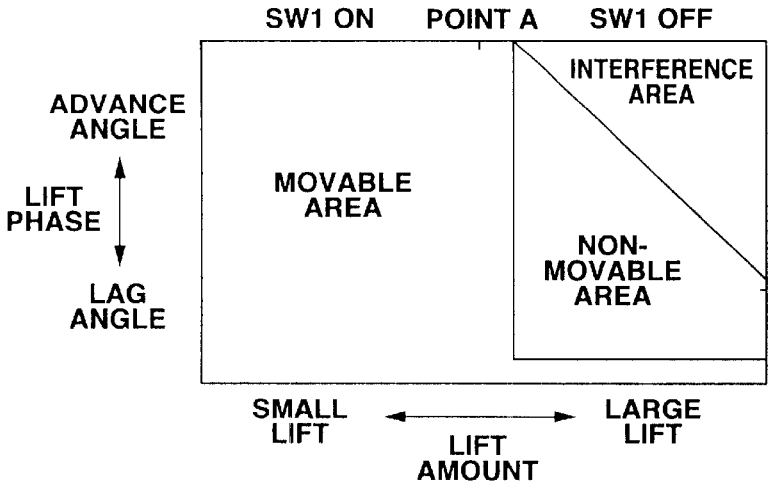
FIG. 27 is a view similar to FIG.26, showing the movable areas of the lift-amount varying mechanism and the lift-phase varying mechanism.

When control shaft 32 rotates in the direction of arrow B in FIG.22 to have the rotation amount greater than a predetermined value or point A in FIG. 26, thereby turning on push switch 78, mechanical-switch circuit 80 outputs a off signal to logic circuit 83. As for the drive instruction signal for lift-phase varying mechanism 2, a on signal is outputted to AND circuit 83*a* of logic circuit 83, so that at the time when mechanical-switch circuit 80 outputs a off signal, control to the advance-angle side by lift-phase varying mechanism 2 is restricted. As a result, referring to FIG. 27, the drive or movable areas of varying mechanisms 1, 2 are securely restricted roughly at point A as a boundary where SW1 becomes turned off. This leads to possible avoiding of interference between piston and intake valve 12 or intake valve 12 and exhaust valve.

Figure 28:
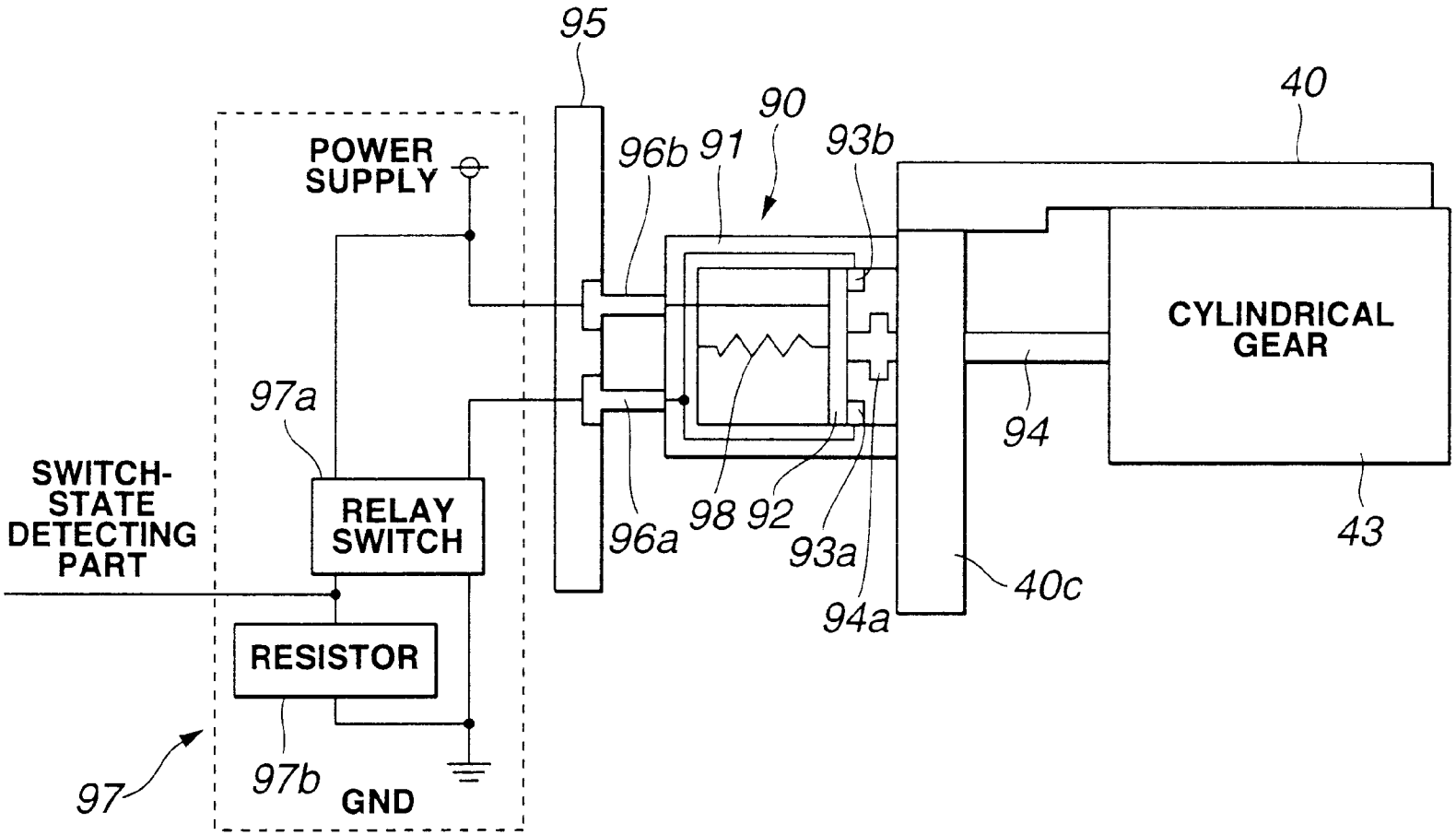
FIG. 28 is a view similar to FIG. 22, showing a fourth embodiment of the present invention.

Referring to FIG. 28, there is shown a fourth embodiment of the present invention wherein mechanical-switch mechanism 90 is provided only to lift-phase varying mechanism 2 with no mechanical-switch mechanism 70 provided to lift-amount varying mechanism 1.

Mechanical-switch mechanism 90 comprises a roughly cylindrical housing 91 fixed to the front face of front cover 40*c* of timing sprocket 40, a disk-like movable contact 92 axially slidably provided in housing 91, two stationary contacts 93*a*, 93*b* fixed to the right inner peripheral surface of housing 91 as viewed in FIG. 28 and on which movable contact 92 abuts as required, a switch pin 94 provided to be contactable and separable from the front face of movable contact 92 and having an end arranged through front cover 40*c* to abut on the front end face of cylindrical gear 43, two brushes 96*a*, 96*b* fixed to a bracket 95 integrated with cylindrical main body 40*a* on the front end side of timing sprocket 40 and connected to movable contact 92 and stationary contact 93, respectively, and a mechanical-switch circuit 97 which is turned on and off by signals provided from brushes 96*a*, 96*b* through slip rings. As described above, cylindrical gear 43 occupies the maximum lag-angle position when it is at a forward position on the side of front cover 40*c*, and occupies the maximum advance-angle position when it is at a backward position away from front cover 40*c*.

Movable contact 92 is biased forward, i.e. in the direction where switch pin 94 abuts on cylindrical gear 43, by a coil spring 98. Switch pin 94 has a flange-like stopper 94*a* on the side of movable contact 92.

Mechanical-switch circuit 97 has the same configuration as that of mechanical-switch circuit 80 of lift-amount varying mechanism 1, comprising a relay switch 97*a* of the normally closed contact type, a resistor 97*b*, etc., wherein the switch-state detecting part is connected to the drive circuit of lift-amount varying mechanism 1. When movable contact 92 is moved backward against the force of coil spring 98 to separate from stationary contacts 93*a*, 93*b* for the off state, the contact of relay switch 97*a* is turned on to provide power-supply voltage to the switch-state detecting part for recognition of the on state. On the other hand, when movable contact 92 is moved forward by the force of coil spring 98 to abut on stationary contacts 93*a*, 93*b* for the on state, the contact of relay switch 97*a* is turned off to provide GND to the switch-state detecting part for recognition of the off state.

Figure 30:
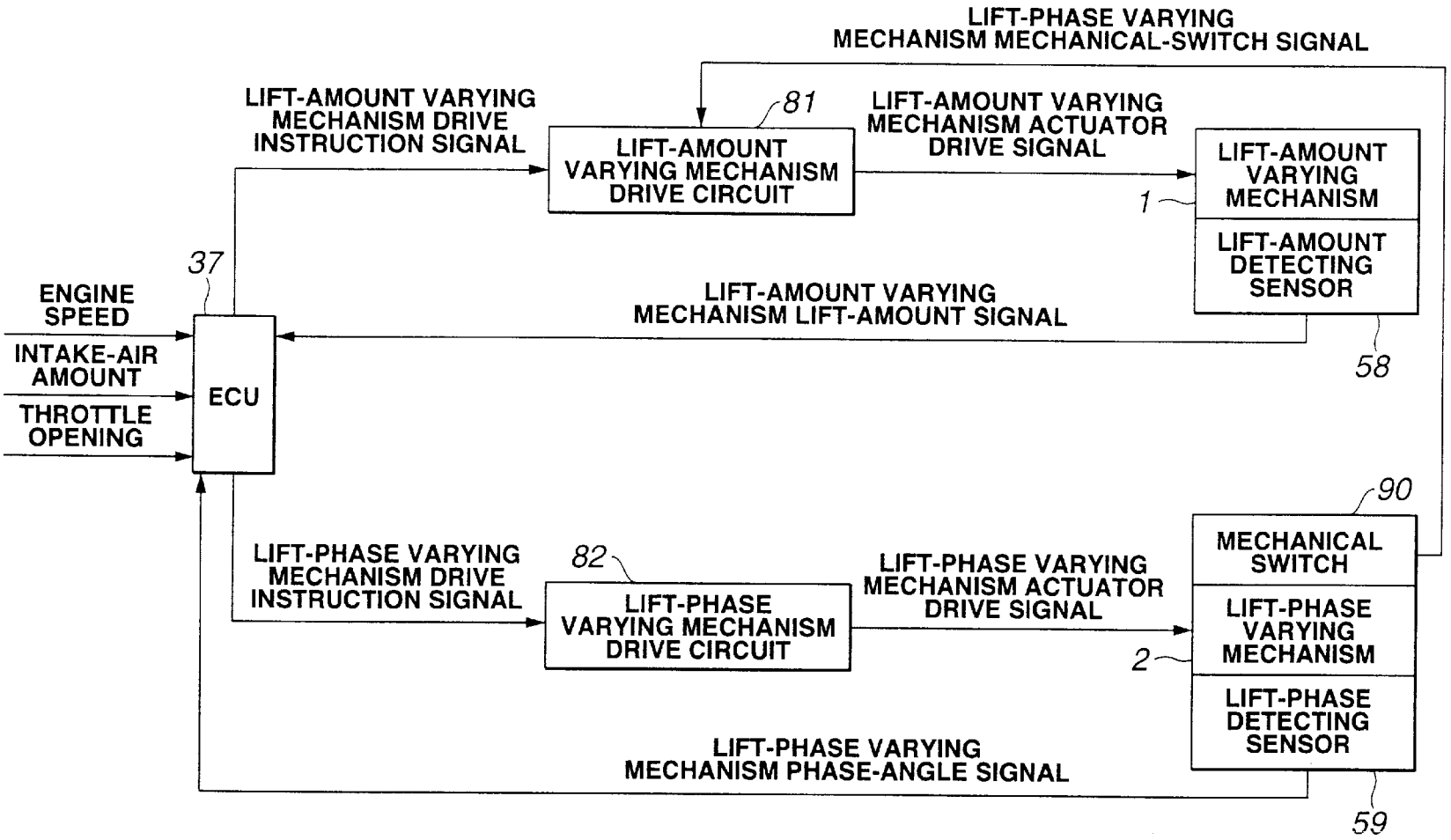
FIG. 30 is a view similar to FIG. 24, showing control in the fourth embodiment.

FIG. 30 is a block diagram showing control of ECU 37 for lift amount mechanism 1 and lift-phase varying mechanism 2, which is basically the same as that in FIG. 24 except that signals derived from mechanical-switch mechanism 90 are provided to lift-amount varying mechanism drive circuit 81.

Figure 31:
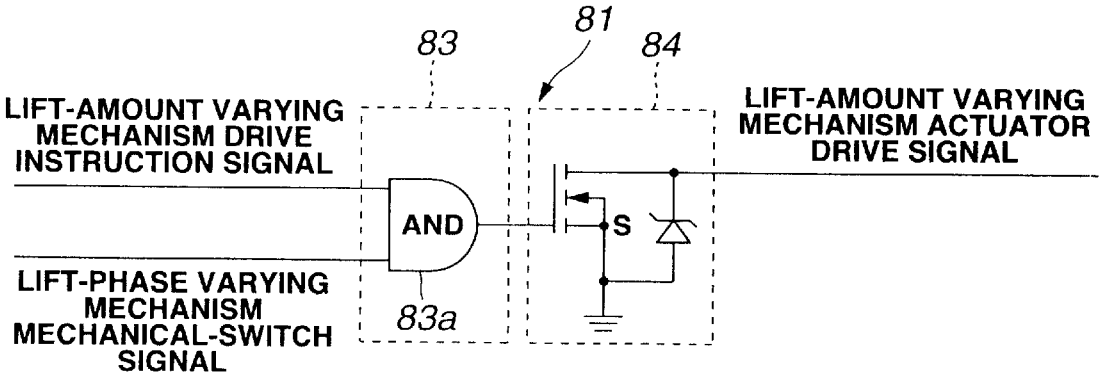
FIG. 31 is a view similar to FIG. 24, showing a drive circuit for the lift-amount varying mechanism.

Specifically, referring to FIG. 31, signals derived from mechanical-switch circuit 97 of mechanical-switch mechanism 90 are inputted, together with a drive instruction signal for lift-amount varying mechanism 1, to AND circuit 83*a* which constitutes logic circuit 83. Then, via drive circuit part 84, they are outputted as actuator driving signals for lift-amount varying mechanism 1.

Figure 29A:
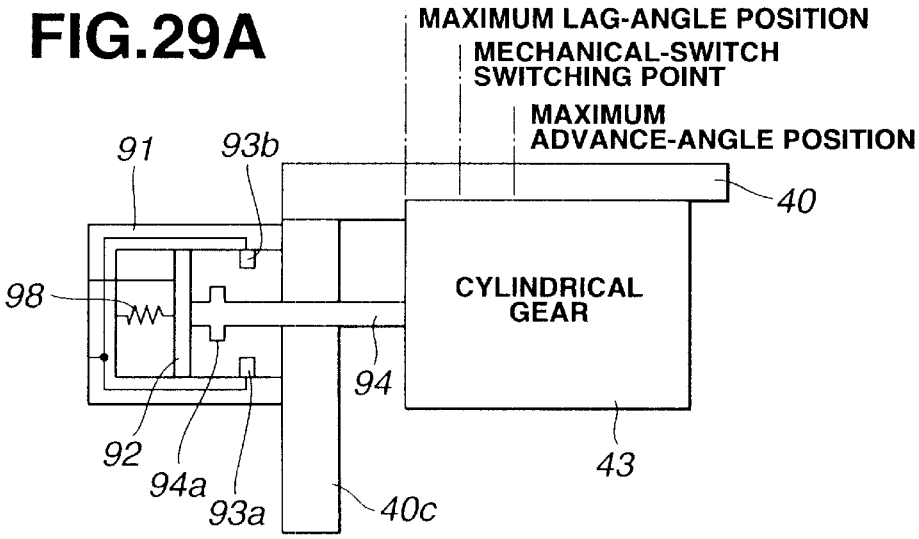
FIGS. 29A–29B are views similar to FIG. 28, showing operation of the mechanical-switch mechanism at maximum lag-angle control and maximum advanced-angle control, respectively.

In this embodiment, therefore, referring to FIG. 29A, when cylindrical gear 43 moves, e.g. toward the maximum lag angle in accordance with the engine operating conditions to have the moving amount greater than a predetermined value, movable contact 92 separates from stationary contacts 93*a*, 93*b* to be turned off. As a result, mechanical-switch circuit 97 is turned on. Referring to FIG. 31, since a drive instruction signal lift-amount varying mechanism 1 is also in the on state, the lift amount of intake valve 12 can be increased as much as possible by lift-amount varying mechanism 1.

Figure 29B:
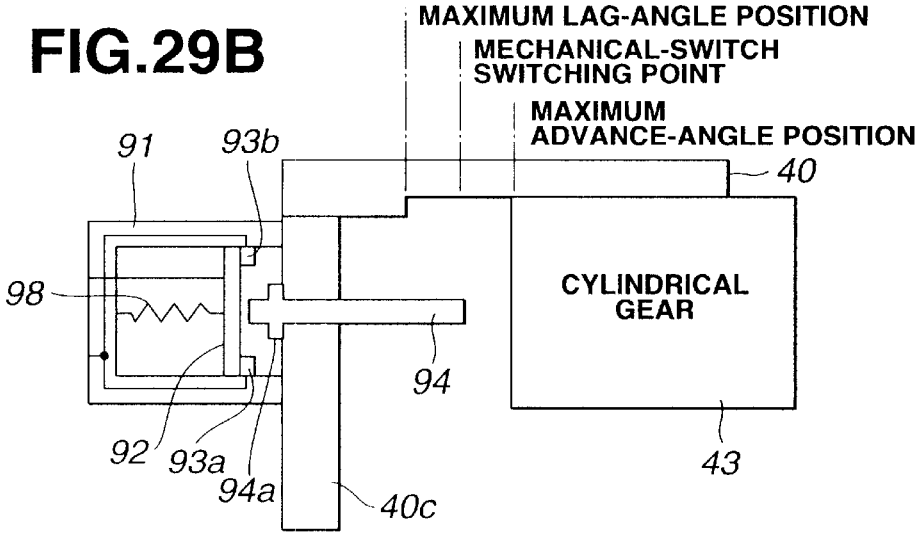
Figure 32:
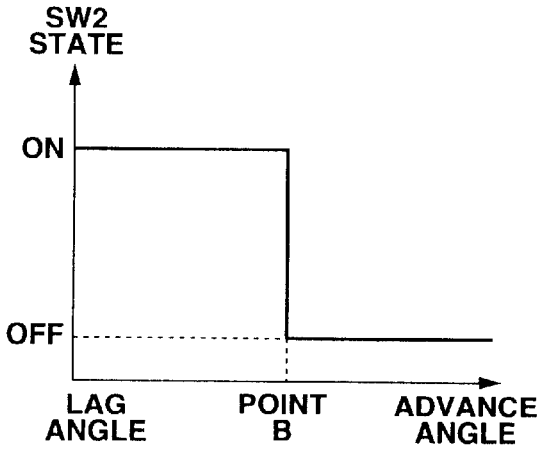
FIG. 32 is a view similar to FIG. 26, showing the on-off switching characteristics of the mechanical-switch mechanism.
Figure 33:
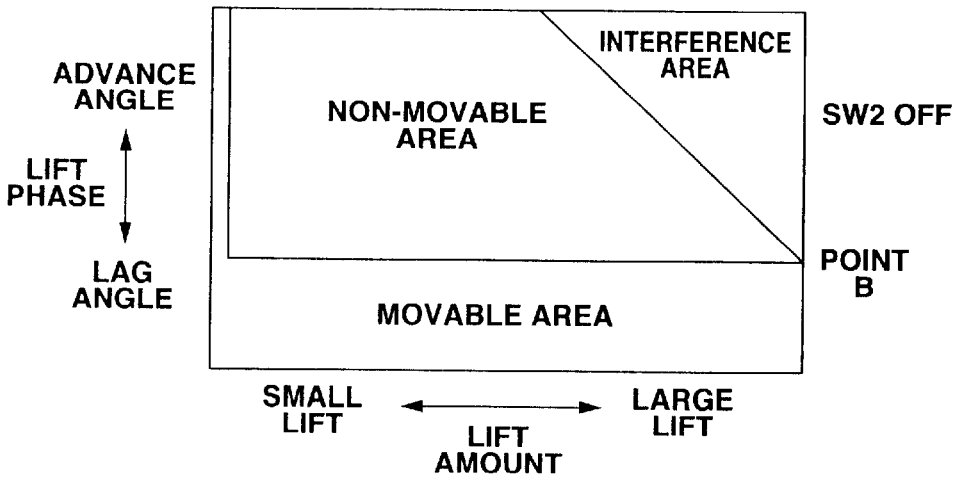
FIG. 33 is a view similar to FIG. 32, showing the movable areas of the lift-amount varying mechanism and the lift-phase varying mechanism.

On the other hand, referring to FIG. 29B, when cylindrical gear 43 moves toward the maximum advance angle to have the moving amount greater than a predetermined value or point B in FIG. 32, movable contact 92 abuts on stationary contacts 93*a*, 93*b* by the force of coil spring 98 to be turned on. As a result, mechanical-switch circuit 97 outputs a off signal to logic circuit 83. As for the drive instruction signal for lift-amount varying mechanism 1, a on signal is outputted to logic circuit 83, so that at the time when mechanical-switch circuit 97 outputs a off signal, control to the lift side of a predetermined value or more by lift-amount varying mechanism 1 is restricted. As a result, referring to FIG. 33, the drive or movable areas of varying mechanisms 1, 2 are securely restricted roughly at point B as a boundary where SW2 becomes turned off. This leads to possible avoiding of interference between piston and intake valve 12 or intake valve 12 and exhaust valve.

Figure 34:
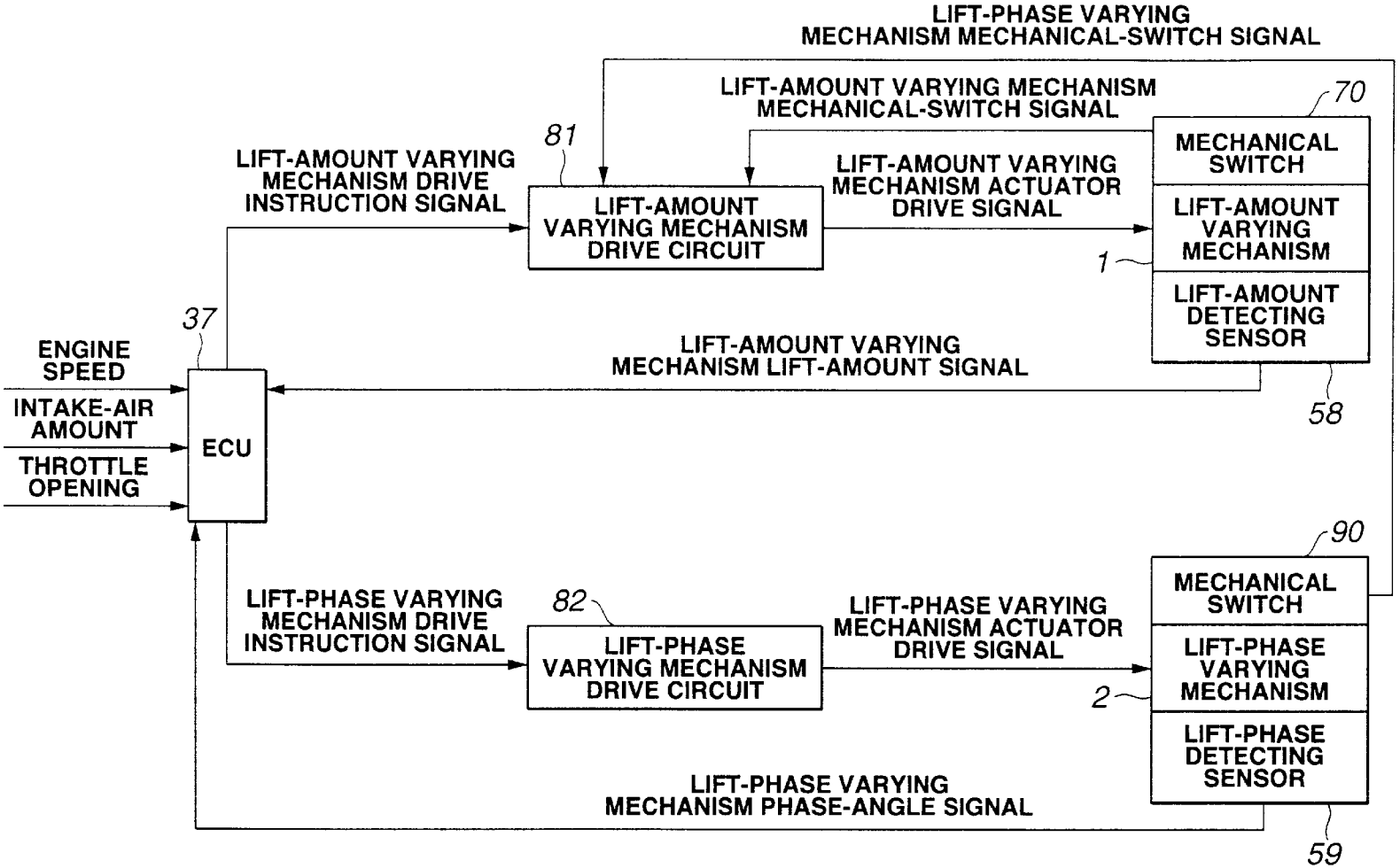
FIG. 34 is a view similar to FIG. 30, showing a fifth embodiment of the present invention.

Referring to FIG. 34, there is shown a fifth embodiment of the present invention wherein varying mechanisms 1, 2 are provided with first and second mechanical-switch mechanisms 70, 90, respectively, mechanical-switch signals of which are outputted to drive circuit 81 of lift-amount varying mechanism 1.

Figure 35:
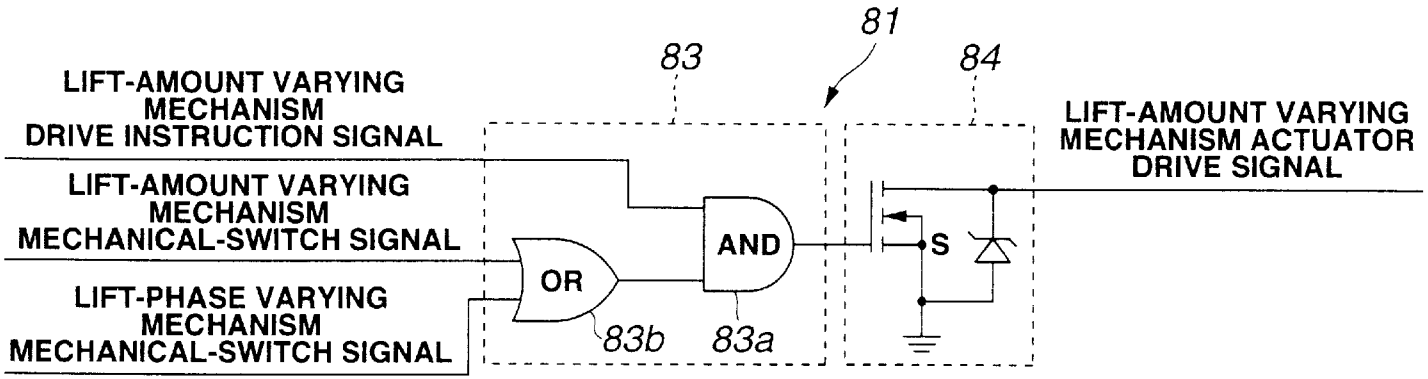
FIG. 35 is a view similar to FIG. 31, showing a drive circuit for the lift-amount varying mechanism.

Specifically, referring to FIG. 35, the drive instruction signal for lift-amount varying mechanism 1 is outputted to AND circuit 83*a* of logic circuit 83, and the mechanical-switch signals are outputted to an OR circuit 83*b* of logic circuit 83. When a on signal of at least one of control shaft 32 and cylindrical gear 43 is inputted to OR circuit 83*b*, an actuator driving signal for lift-amount varying mechanism 1 is provided. When two off signals are inputted, i.e. the lift amount and lift phase are greater and more advanced than respective predetermined values, lift control of lift-amount varying mechanism 1 is restricted through drive circuit 84.

Figure 36:
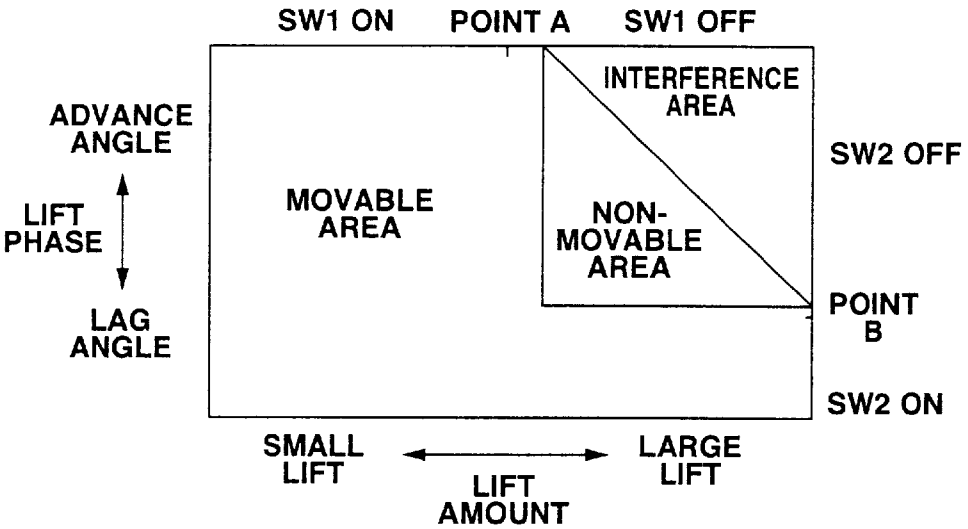
FIG. 36 is a view similar to FIG. 33, showing the movable areas of the lift-amount varying mechanism and the lift-phase varying mechanism.

In this embodiment, therefore, both varying mechanisms 1, 2 can be controlled relatively accurately, resulting in not only achievement of the effect of avoiding interference between piston and intake valve 12, but also provision of relatively large drive or movable areas as shown in FIG. 36.

Figure 37:
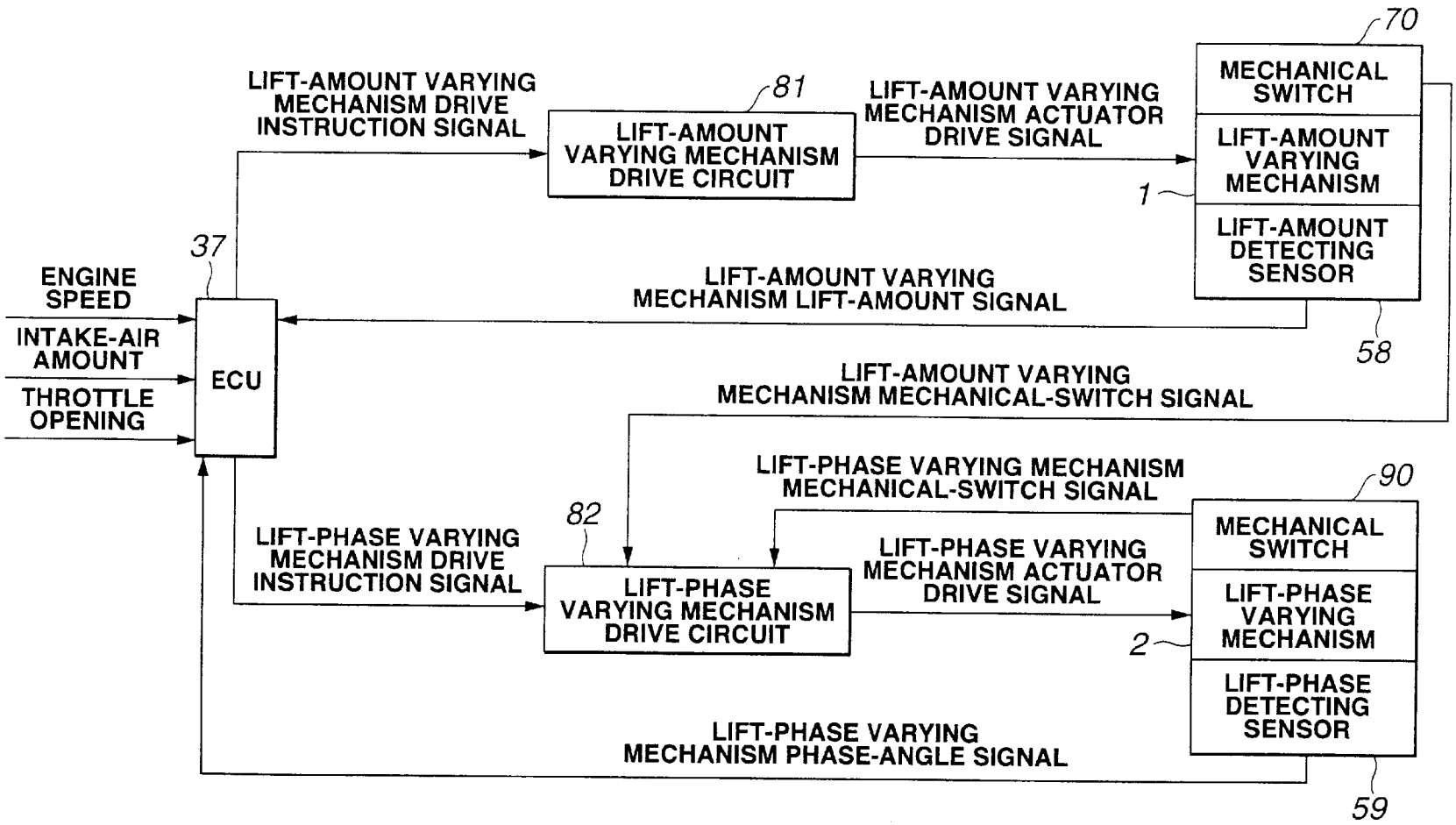
FIG. 37 is a view similar to FIG. 34, showing a sixth embodiment of the present invention.

FIG. 37 shows a sixth embodiment of the present invention wherein varying mechanisms 1, 2 are provided with first and second mechanical-switch mechanisms 70, 90, but mechanical-switch signals of which are outputted to drive circuit 82 of lift-phase varying mechanism 2.

Figure 38:
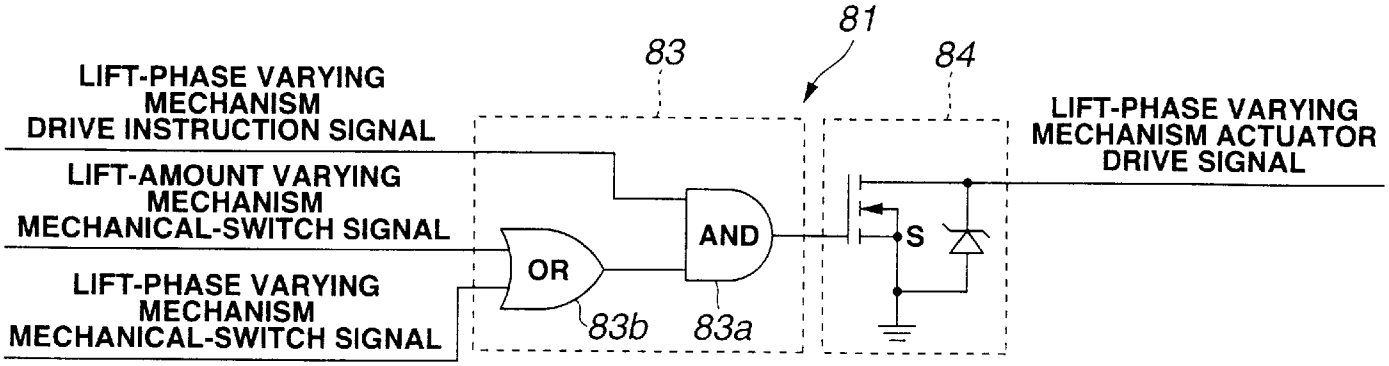
FIG. 38 is a view similar to FIG. 35, showing a drive circuit for the lift-amount varying mechanism.

Specifically, referring to FIG. 38, the drive instruction signal for lift-phase varying mechanism 2 is inputted to AND circuit 83*a* of logic circuit 83, and the mechanical-switch signals are inputted to OR circuit 83*b* of logic circuit 83. When a on signal of either control shaft 32 or cylindrical gear 43 is inputted to OR circuit 83*b*, an actuator driving signal for lift-phase varying mechanism 2 is provided. When two off signals are inputted, i.e. the lift amount and lift phase are greater and more advanced than respective predetermined values, lift control of lift-phase varying mechanism 2 is restricted through drive circuit 84.

Figure 39:
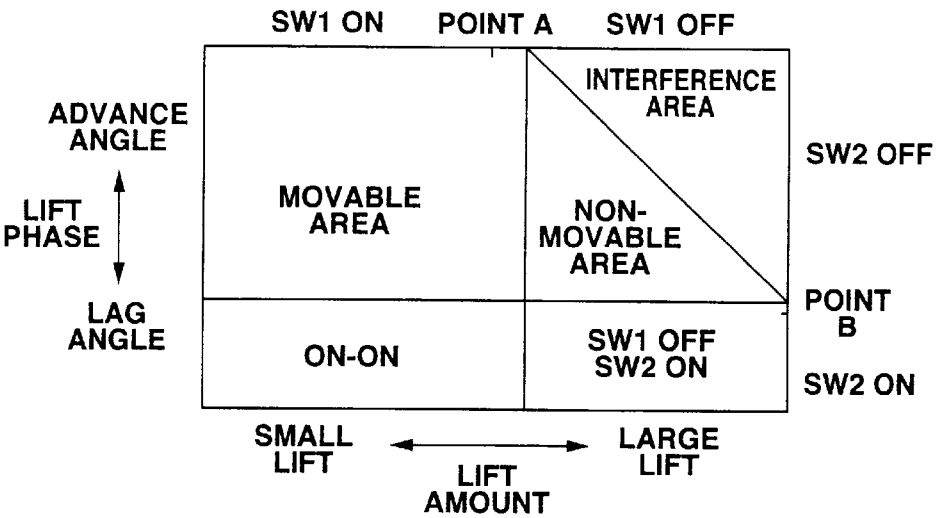
FIG. 39 is a view similar to FIG. 36, showing the movable areas of the lift-amount varying mechanism and the lift-phase varying mechanism.

In this embodiment also, both varying mechanisms 1, 2 can be controlled relatively accurately, resulting in not only the effect of avoiding interference between piston and intake valve 12, but also provision of relatively large drive or movable areas as shown in FIG. 39.

Having described the present invention with regard to the illustrative embodiments, it is noted that the present invention is not limited thereto, and various changes and modifications can be made without departing from the scope of the present invention. By way of example, the present invention can be applied to the exhaust side.

The entire contents of Japanese Patent Application 2001-138206 filed May 9, 2001 are incorporated hereby by reference.

What is claimed is:

1. A variable-valve-actuation (VVA) apparatus for an internal combustion engine, comprising:

a first varying mechanism which controls a lift amount of an engine valve in accordance with engine operating conditions;

a second varying mechanism which controls a lift phase of the engine valve in accordance with the engine operating conditions;

a first sensor which detects an actual position of the first varying mechanism, the actual position corresponding to an actual lift amount;

a second sensor which detects an actual position of the second varying mechanism, the actual position corresponding to an actual lift phase; and an electronic control unit (ECU) which controls the lift amount and the lift phase to first and second basic target values through the first and second varying mechanisms, respectively, wherein when the actual lift amount exceeds the first basic target value by a predetermined value or more, the ECU corrects the lift phase through the second varying mechanism to separate from a top dead center (TDC) of a piston with respect to the second basic target value.

2. A variable-valve-actuation (VVA) apparatus for an internal combustion engine, comprising:

a first varying mechanism which controls a lift amount of an engine valve in accordance with engine operating conditions;

a second varying mechanism which controls a lift phase of the engine valve in accordance with the engine operating conditions;

a first sensor which detects an actual position of the first varying mechanism, the actual position corresponding to an actual lift amount;

a second sensor which detects an actual position of the second varying mechanism, the actual position corresponding to an actual lift phase; and an electronic control unit (ECU) which controls the lift amount and the lift phase to first and second basic target values through the first and second varying mechanisms, respectively, wherein when the actual lift phase varies to approach by a predetermined value or more a top dead center (TDC) of a piston with respect to the second basic target value, the ECU corrects the lift amount through the first varying mechanism to be smaller than the first basic target value.

3. The VVA apparatus as claimed in claim 1, wherein even when the actual lift amount exceeds the first basic target value by the predetermined value or more, when the actual lift phase lies to separate from the TDC with respect to the corrected lift phase, the ECU controls the lift phase through the second varying mechanism to be the second basic target value.

4. The VVA apparatus as claimed in claim 2, wherein even when the actual lift phase varies to approach by the predetermined value or more the TDC with respect to the second basic target value, when the actual lift amount is smaller than the corrected lift amount, the ECU controls the lift amount through the first varying mechanism to be the first basic target value.

5. The VVA apparatus as claimed in claim 1, wherein the ECU determines if a failure of the first sensor occurs, wherein if it is determined that the failure occurs, even when the actual lift amount is maximum, the ECU controls the lift phase through the second varying mechanism to be within a range where interference can be avoided between the engine valve and the piston and between the engine valve and another engine valve.

6. The VVA apparatus as claimed in claim 2, wherein the ECU determines if a failure of the second sensor occurs, wherein if it is determined that the failure occurs, even when the actual lift phase is closest to the TDC, the ECU controls the lift amount through the first varying mechanism to be within a range where interference can be avoided between the engine valve and the piston and between the engine valve and another engine valve.

7. The VVA apparatus as claimed in claim 5, further comprising a first auxiliary sensor, wherein the ECU determines occurrence of the failure of the first sensor in accordance with signals derived from the first sensor and the first auxiliary sensor.

8. The VVA apparatus as claimed in claim 6, further comprising a second auxiliary sensor, wherein the ECU determines occurrence of the failure of the second sensor in accordance with signals derived from the second sensor and the second auxiliary sensor.

9. A variable-valve-actuation (VVA) apparatus for an internal combustion engine, comprising:

a first varying mechanism which controls a lift amount of an engine valve in accordance with engine operating conditions;

a second varying mechanism which controls a lift phase of the engine valve in accordance with the engine operating conditions;

a first sensor which detects an actual position of the first varying mechanism, the actual position corresponding to an actual lift amount;

a second sensor which detects an actual position of the second varying mechanism, the actual position corresponding to an actual lift phase;

an auxiliary sensor which detects at least one of the lift amount and the lift phase; and an electronic control unit (ECU) which feedback-controls the lift amount to a first basic target value through the first varying mechanism in accordance with a signal derived from the first sensor and the lift phase to a second basic target value through the second varying mechanism in accordance with a signal derived from the second sensor, wherein the ECU determines if a failure of one of the first and second sensors occurs in accordance with signals derived from one of the first and second sensors and the auxiliary sensor.

10. The VVA apparatus as claimed in claim 9, wherein if it is determined that the failure occurs, even when the lift amount is controlled to be maximum through the first varying mechanism, the ECU controls the lift phase through the second varying mechanism to be within a range where interference can be avoided between the engine valve and the piston and between the engine valve and another engine valve.

11. The VVA apparatus as claimed in claim 9, wherein if it is determined that the failure occurs, even when the lift phase is controlled to be closest to the TDC through the second varying mechanism, the ECU controls the lift amount through the first varying mechanism to be within a range where interference can be avoided between the engine valve and the piston and between the engine valve and another engine valve.

12. The VVA apparatus as claimed in claim 9, wherein the first varying mechanism comprises a valve operating (VO) cam, a timing sensor which detects a timing where the VO cam passes through a predetermined rocking position, and an auxiliary timing sensor which detects an auxiliary timing where the VO cam passes through the predetermined rocking position.

13. The VVA apparatus as claimed in claim 10, wherein the ECU determines through operation:

the lift amount in accordance with a value of up-timing where the VO cam passes through the predetermined rocking position when valve lift increases and a value of down-timing where the VO cam passes through the predetermined rocking position when valve lift decreases;

the lift phase in accordance with the up-timing value and the down-timing value;

the lift amount in accordance with a value of auxiliary up-timing where the VO cam passes through the predetermined rocking position when valve lift increases and a value of auxiliary down-timing where the VO cam passes through the predetermined rocking position when valve lift decreases; and the lift phase in accordance with the auxiliary up-timing value and the auxiliary down-timing value.

14. A variable-valve-actuation (VVA) apparatus for an internal combustion engine, comprising:

a first varying mechanism which controls a lift amount of an engine valve in accordance with engine operating conditions;

a second varying mechanism which controls a lift phase of the engine valve in accordance with the engine operating conditions;

a drive circuit which actuates the second varying mechanism;

a mechanical-switch mechanism logically connected to the drive circuit, the mechanism providing one of on and off signals in accordance with the lift amount; and an electronic control unit (ECU) which controls the lift amount and the lift phase to first and second basic target values through the first and second varying mechanisms, respectively, wherein when the lift amount is greater than a predetermined value, the ECU controls through the second varying mechanism and in accordance with the off signal the lift phase to separate from a top dead center (TDC) of a piston.

15. A variable-valve-actuation (VVA) apparatus for an internal combustion engine, comprising:

a first varying mechanism which controls a lift amount of an engine valve in accordance with engine operating conditions;

a second varying mechanism which controls a lift phase of the engine valve in accordance with the engine operating conditions;

a drive circuit which actuates the first varying mechanism;

a mechanical-switch mechanism logically connected to the drive circuit, the mechanism providing one of on and off signals in accordance with the lift phase; and an electronic control unit (ECU) which controls the lift amount and the lift phase to first and second basic target values through the first and second varying mechanisms, respectively, wherein when the lift phase approaches a top dead center (TDC) of a piston by a predetermined value or more, the ECU controls through the first varying mechanism and in accordance with the off signal the lift amount to be smaller.

16. A variable-valve-actuation (VVA) apparatus for an internal combustion engine, comprising:

a first varying mechanism which controls a lift amount of an engine valve in accordance with engine operating conditions;

a second varying mechanism which controls a lift phase of the engine valve in accordance with the engine operating conditions;

a drive circuit which actuates the first varying mechanism;

a first mechanical-switch mechanism logically connected to the drive circuit, the mechanism providing one of on and off signals in accordance with the lift amount;

a second mechanical-switch mechanism logically connected to the drive circuit, the mechanism providing one of on and off signals in accordance with the lift phase;

an electronic control unit (ECU) which controls the lift amount and the lift phase to first and second basic target values through the first and second varying mechanisms, respectively, wherein when the lift amount is greater than a predetermined value, the ECU controls through the first varying mechanism and in accordance with the off signal of the first mechanical-switch mechanism the lift amount to be smaller, wherein when the lift phase approaches a top dead center (TDC) of a piston by a predetermined value, the ECU controls through the first varying mechanism and in accordance with the off signal of the second mechanical-switch mechanism the lift amount to be smaller.

17. A variable-valve-actuation (VVA) apparatus for an internal combustion engine, comprising:

a first varying mechanism which controls a lift amount of an engine valve in accordance with engine operating conditions;

a second varying mechanism which controls a lift phase of the engine valve in accordance with the engine operating conditions;

a drive circuit which actuates the second varying mechanism;

a first mechanical-switch mechanism logically connected to the drive circuit, the mechanism providing one of on and off signals in accordance with the lift amount;

a second mechanical-switch mechanism logically connected to the drive circuit, the mechanism providing one of on and off signals in accordance with the lift phase;

an electronic control unit (ECU) which controls the lift amount and the lift phase to first and second basic target values through the first and second varying mechanisms, respectively, wherein when the lift amount is greater than a predetermined value, the ECU controls through the second varying mechanism and in accordance with the off signal of the first mechanical-switch mechanism the lift phase to separate from a top dead center (TDC) of a piston, wherein when the lift phase approaches the TDC by a predetermined value or more, the ECU controls through the second varying mechanism and in accordance with the off signal of the second mechanical-switch mechanism the lift phase to separate from the TDC.

* * * * *